US009520640B2

(12) United States Patent
Truthan

(10) Patent No.: US 9,520,640 B2
(45) Date of Patent: Dec. 13, 2016

(54) ELECTROMAGNETICALLY COUPLED BROADBAND MULTI-FREQUENCY MONOPOLE WITH FLEXIBLE POLYMER RADOME ENCLOSURE FOR WIRELESS RADIO

(71) Applicant: Electro-Magwave, Inc., Valley View, OH (US)

(72) Inventor: Robert Truthan, Cuyahoga Falls, OH (US)

(73) Assignee: Electro-Magwave, Inc., Valley View, OH (US)

( * ) Notice: Subject to any disclaimer, the term of this patent is extended or adjusted under 35 U.S.C. 154(b) by 200 days.

(21) Appl. No.: 14/221,592

(22) Filed: Mar. 21, 2014

(65) Prior Publication Data

US 2014/0285394 A1 Sep. 25, 2014

Related U.S. Application Data

(63) Continuation-in-part of application No. 13/338,427, filed on Dec. 28, 2011, now abandoned.

(Continued)

(51) Int. Cl.
*H01Q 1/24* (2006.01)
*H01Q 1/40* (2006.01)

(Continued)

(52) U.S. Cl.
CPC ..... *H01Q 1/242* (2013.01); *H01Q 1/405* (2013.01); *H01Q 5/364* (2015.01); *H01Q 9/36* (2013.01)

(58) Field of Classification Search
CPC ..... H01Q 1/242; H01Q 1/405; H01Q 9/36; H01Q 5/364

(Continued)

(56) References Cited

U.S. PATENT DOCUMENTS 3,267,476 A * 8/1966 Finke ..... H01Q 1/085 343/715
4,115,783 A * 9/1978 Reggia ..... H01Q 1/08 343/792

(Continued)

OTHER PUBLICATIONS

The ARRL Antenna Book, Published by the American Radio Relay League.*

(Continued)

*Primary Examiner* — Dameon E Levi
*Assistant Examiner* — Awat Salih
(74) *Attorney, Agent, or Firm* — Emerson Thomson Bennett, LLC; Roger D. Emerson; Sergey Vernyuk

(57) ABSTRACT

Disclosed herein is a top load multi-band monopole antenna that is utilized with an integrated electromagnetic coupling feed wire and resonator combination achieving broad band and multi-band performance for multiple frequency spectrums. The top loaded monopole can utilize 450-520 MHz, 698 through 960 MHz and 1000 through 3000 MHz bands contiguously and simultaneously by implementation of the coupling feed wire and resonator combination. The electromagnetically coupled top load resonator in conjunction with the lower monopole resonator section matches impedance for both low frequency and high frequency range operation. A flexible radome housing structure augments impact resistance by permitting the monopole radiator aperture to flex under mechanical load while maintaining reliable signal transmission and reception properties.

14 Claims, 24 Drawing Sheets

Related U.S. Application Data

(60) Provisional application No. 61/804,987, filed on Mar. 25, 2013, provisional application No. 61/428,166, filed on Dec. 29, 2010.

(51) Int. Cl.
*H01Q 9/36* (2006.01)
*H01Q 5/364* (2015.01)

(58) Field of Classification Search
USPC ..... 343/715, 745, 749, 750, 900, 790, 791,343/792, 872–873
See application file for complete search history.

(56) References Cited

U.S. PATENT DOCUMENTS 4,134,121 A * 1/1979 Northcutt ..... H01Q 1/3275 343/715
4,435,713 A * 3/1984 Gasparaitis ..... H01Q 9/30 343/702
4,462,033 A * 7/1984 Grashow ..... H01Q 9/30 343/715
4,513,290 A * 4/1985 Lefevre ..... H01Q 9/005 343/745
5,061,940 A * 10/1991 Blaese ..... H01Q 1/088 343/715
5,101,213 A * 3/1992 Harada ..... H01Q 1/088 343/715
5,179,387 A * 1/1993 Wells ..... H01Q 9/30 343/715
5,189,387 A * 2/1993 Childers ..... H02H 9/044 338/20
5,189,435 A * 2/1993 Yarsunas ..... H01Q 21/30 343/715
5,220,341 A * 6/1993 Yamazaki ..... H01Q 1/10 343/715
5,233,363 A * 8/1993 Yarsunas ..... H01Q 1/088 343/715
5,502,452 A * 3/1996 Gomez ..... H01Q 1/1214 343/715
5,751,251 A * 5/1998 Hutchinson ..... H01Q 1/32 343/715
6,008,768 A * 12/1999 Wilson ..... H01Q 1/3275 343/713
6,275,198 B1 * 8/2001 Kenoun ..... H01Q 1/242 343/702
6,356,237 B1 * 3/2002 Kim ..... H01Q 1/243 343/713
6,400,327 B1 * 6/2002 Galvin ..... H01Q 1/3291 340/444
6,608,597 B1 8/2003 Hadzoglou et al.
6,683,570 B2 1/2004 Skladany et al.
6,788,261 B1 * 9/2004 Buren ..... H01Q 9/40 343/715
6,859,181 B2 2/2005 Colburn et al.
6,888,514 B2 * 5/2005 Sheng-Gen ..... H01Q 1/242 343/715
7,034,757 B2 * 4/2006 Martek ..... H01Q 1/36 343/715
7,102,576 B2 * 9/2006 Kim ..... H01Q 1/242 343/702
7,180,460 B1 * 2/2007 Bogdans ..... H01Q 1/002 343/715
7,852,283 B2 * 12/2010 Eide ..... H01Q 1/3275 343/715
8,077,097 B2 * 12/2011 Chung ..... H01Q 1/2291 343/702
8,162,698 B2 * 4/2012 Johnson ..... H01Q 1/088 439/675
8,299,372 B2 * 10/2012 Swais ..... H01Q 1/00 174/377
2002/0050955 A1 * 5/2002 Strickland ..... H01Q 9/28 343/895
2003/0227419 A1 * 12/2003 Hung ..... H01Q 9/16 343/790
2003/0231140 A1 * 12/2003 Haussler ..... H01Q 1/3275 343/888
2004/0246185 A1 * 12/2004 Macqueen ..... H01Q 1/242 343/702
2007/0176844 A1 * 8/2007 Cislo ..... H01Q 1/005 343/878
2009/0085824 A1 * 4/2009 Swais ..... H01Q 1/1207 343/878
2010/0245200 A1 * 9/2010 Swais ..... H01Q 1/246 343/790
2012/0169556 A1 * 7/2012 Truthan ..... H01Q 5/335 343/752

OTHER PUBLICATIONS

The American Radio Relay League , By Gerald (Jerry) Hall, ISBN: 0-87259-206-5.*

* cited by examiner

ELECTROMAGNETICALLY COUPLED BROADBAND MULTI-FREQUENCY MONOPOLE WITH FLEXIBLE POLYMER RADOME ENCLOSURE FOR WIRELESS RADIO

BACKGROUND OF THE INVENTION

The US Government Federal Communications Commission's (FCC) more recent allocation of wireless radio frequency spectrum included moving or relocating various regional/national terrestrial broadcast services to lower frequency bands, in order to provide a structured opportunity for broadband multi-band wireless services in support of homeland security, land mobile radio for first responders, and fixed and mobile personal or commercial voice, video and data communications. The structural bandwidth allocated for these new services was arranged in a manner where hardware and system designers can utilize licensed carrier frequencies operating within a broadband contiguous spectrum in conjunction with other frequency bands separated, but related by a multiple or fractional order. Additionally, the upper portion spectrum was aligned with the standard for Universal Mobile Telecommunication Services (UMTS) in attempt to provide universal standardization across the globe. The acronym for this assembly of spectrum and for the intended application, is commonly referred to as 4G or LTE, or in some cases 4G/LTE. "4G" defined as the acronym for fourth generation cellular service, and LTE referring to Long Term Evolution, implying that the digital modulation protocol is intended to be a continuously evolving global standard for communications. Various radio systems incorporating digital voice, data and location services are evolving in combination with requirements to operate simultaneously across multiple bands in the VHF (100-200 MHz), UHF (380-520 MHz) and 700-900 MHz spectrum, in support of public safety and homeland security initiatives. These initiatives are spurring inventors toward multiple band antenna system designs to augment cooperative communications amongst multiple local, regional and national safety and security officials.

For example, cellular carriers were originally licensed to operate in the spectrum of 800 MHz (806-894 MHz) using traditional analog advanced mobile phone technology. With years of experience along with the introduction of enhanced digital modulation schemes, they can now provide advanced cooperative services in the 1700-1900 MHz bands. This was all made possible after several years and rounds of auctions, hosted by the FCC. These higher bands provide an approximate mathematical doubling (2×, and in some bands 3×) of the original 800 MHz bands. Furthermore, by extending these separate bands (800 and 1700-1900 MHz) into locally adjacent bands operating with advanced digital modulations, the spectral capacity is greatly increased. This of course is dependent upon hardware designers achieving efficient design platforms that meet the performance objectives established by the system architectural requirements. This hardware, operating with expanded frequency spectra, delivers voice and various data content via increased speed (bandwidth) and digitally encrypted capabilities to emergency personnel and end user public and private subscriber telecommunication services. Technological strides achieved in the consumer cellular markets combined with the fact that their respective spectra are interlaced with adjacent land mobile and public safety bands, increasingly build interest within the wireless industry to interlace or overlay cellular communications with the land mobile and public safety segments, regardless of the regulatory and technical challenges. The cellular communication services are currently operating in the 700-900 MHz and 1700-2200 MHz bands, whereas Private Land Mobile and Public Safety services operate in the 100-225 MHz, 380-520 MHz and 740-870 MHz bands.

Traditional monopole antennas are implemented in a variety of configurations for ground plane dependent wireless radio applications. Monopole radiators (e.g., monopole antennas) are often referred as "quarter-wave" antennas due to their characteristic requirement of their physical length approximating one-fourth (¼) wavelength at the desired frequency of operation, and are considered to be one of the most fundamental structures to achieve efficient omni-directional Radio Frequency (RF)/Microwave radiation. Monopoles also provide reasonably broad band performance relative to their desired operational frequency, and can be designed for efficient radiation in excess of 25% to 30% of total operational bandwidth.

Monopoles can be comprised of a conductive thin diameter wire radiator (primary conductor) oriented in a vertically normal position with respect to a close proximity conductive ground plane surface (secondary conductor). The ground plane is typically several wavelengths in diameter or infinitely sized for theoretical considerations. RF voltage is applied across the two conductors through a small isolated feed point near the center of the ground plane. It is important to note that the monopole antenna cannot physically exist without the ground plane. The ground plane is an integral part of the monopole impedance and radiation characteristics. Theoretically, the monopole is defined by its quarter-wave length size emanating from the existence of an infinite (very large) ground plane and defined by image theory of a virtual source on the opposite side of the ground plane, establishing dipole like characteristics.

Designing the monopole requires a design methodology to implement a vertical radiator approximating the desired one-fourth (¼) wavelength structure, and is a well known practice to those skilled in the art of antenna design. Furthermore, enhancing the bandwidth, radiation efficiency and reducing the physical height (length) of the monopole enable great flexibility in their employment.

A common design implementation includes top loading the monopole by physically increasing the diameter of the primary conductor at the highest point (maximum RF voltage) which effectively reduces the total physical height while simultaneously increasing the electrical length. The top load implementation results in a shorter physical radiator, operating at a lower and much broader RF frequency range. Other bandwidth enhancing techniques include increasing the physical diameter of the primary conductor, in effect decreasing the Length-to-Diameter (L/D) ratio with a benefit to reducing the total physical height and increasing operational bandwidth.

Mobile antennas and specifically, mobile monopole antennas are prominently utilized in various arenas. For example, mobile antennas are employed in the areas of Land Mobile Radio (LMR), public safety, homeland security, cellular, telematics, telemetry, in-building, portable applications, and the like. Such mobile antennas can be mounted using a physical mount to a surface or a magnet temporarily attached to a surface, etc. Yet, one mount technique has come to fruition as a standard for mobile antennas. In particular, a New Motorola™ (NMO) mount (herein referred to as the NMO mount) has become the industry standard for mobile antenna mounts, specifically mounting mobile antennas to automobiles.

SUMMARY OF THE INVENTION

In accordance with one aspect of the present invention, an antenna includes: a radiator element including an upper portion, a lower portion, and an axis running from the upper portion to the lower portion; a top load radiator cap electromagnetically coupled to the upper portion of the radiator element and matching an impedance of the antenna for at least one low frequency signal, wherein the top load radiator cap is made from a conductive material; and a first resonator directly connected to the lower portion of the radiator element and matching an impedance of the antenna for at least one high frequency signal.

In accordance with another aspect of the present invention, an antenna includes: a radiator element including an upper portion, a lower portion, and an axis running from the upper portion to the lower portion; a first resonator directly connected to the lower portion of the radiator element and matching an impedance of the antenna for at least one high frequency signal; and a top load radiator assembly including a top load radiator adapter made from a conductive material, a top load radiator coil made from a conductive material and secured directly to the top load radiator adapter, and a top load radiator housing made from a non-conductive material and enclosing at least a part of a) the top load radiator adapter, and b) the top load radiator coil; wherein the top load radiator assembly is electromagnetically coupled to the upper portion of the radiator element and matches an impedance of the antenna for at least one low frequency signal.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF AN EXEMPLARY EMBODIMENT

Figure 1:
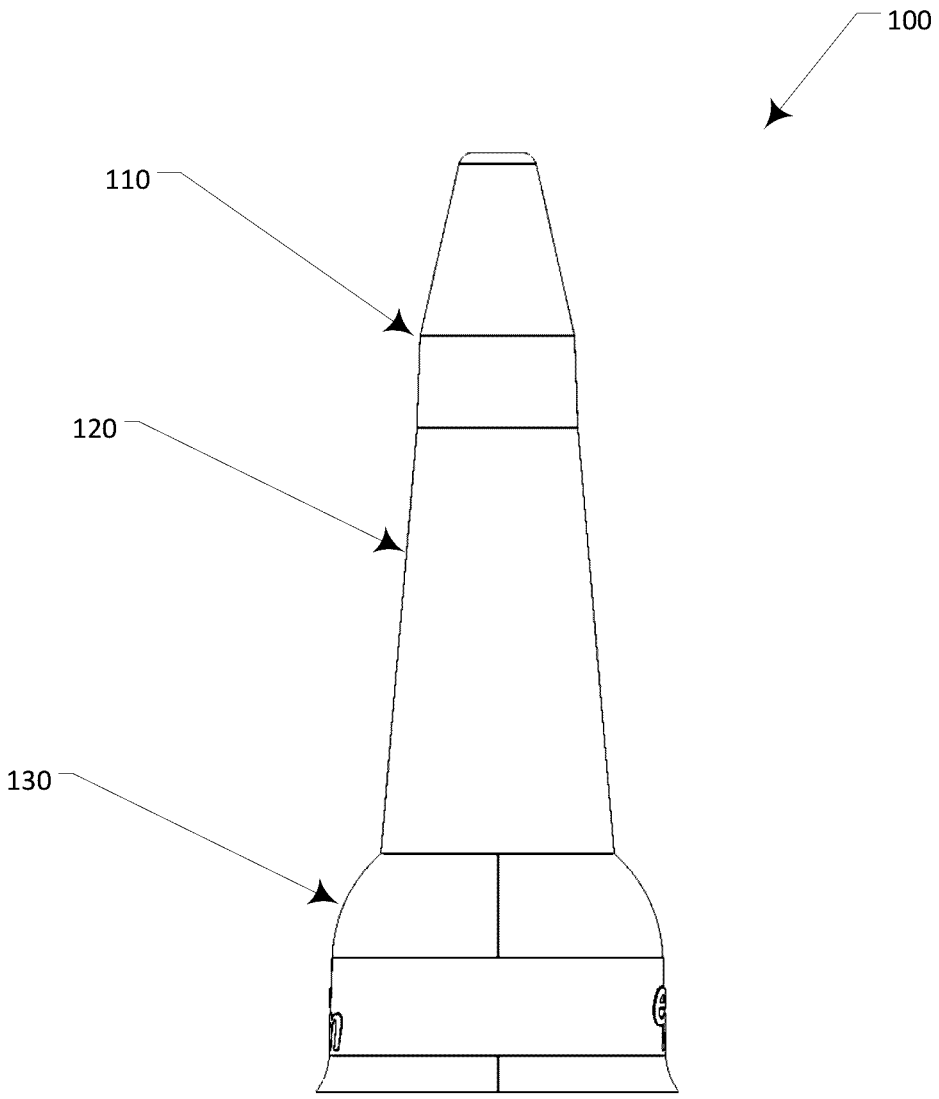
FIG. 1 is a front view of a monopole type antenna that provides for multi-frequency band communication.

The inventor has perceived that one mount technique has come to fruition as a standard for mobile antennas. In particular, a New Motorola™ (NMO) mount (herein referred to as the NMO mount) has become the industry standard for mobile antenna mounts, specifically mounting mobile antennas to automobiles. However, the NMO mount has performance issues with higher frequencies due to signal reflection, which tends to cause problems when the NMO mount is used with frequencies higher than 1 GHz.

The inventor has also perceived that since the NMO mount is standardized and utilized throughout the mobile antenna industry, this can lead to many complications in attempts to extend monopole antennas to different frequency spectrums such as a lower frequency and a higher frequency (e.g., above 1 GHz), simultaneously. Furthermore, mobile antenna consumers benefit from having mobile antennas compatible across multiple frequency spectrums. However, based on the complications surrounding the NMO mount, options are limited in order to utilize a mobile antenna with an NMO mount while communicating with low and high frequencies. Solutions are often costly and complicated since multiple antennas and mounts are typically implemented.

The following disclosure provides a brief summary of the innovative technology discussing basic concepts in a simplified manner. The items presented herein shall not be limited to critically required components necessary to achieve the design, nor will present any limitations for the overall scope of the exemplary embodiment. The purpose of this description is to merely provide a clear and concise explanation of an exemplary embodiment.

The exemplary embodiment pertains to an antenna device that operates simultaneously within a low frequency band and a high frequency band. The antenna may be a top loaded monopole device that includes an electromagnetically coupled feed that matches the impedance with an upper portion of the top loaded monopole antenna for a high and low frequency signal (e.g., below and above 1 GHz). By matching the impedance with the electromagnetically coupled feed radiator, the antenna may radiate and receive a low frequency signal and a high frequency signal without interference from one another. Furthermore, the electromagnetically coupled top loaded monopole antenna may further be adjusted (e.g., materials, size, ratios, etc.) to target specific frequencies within both a low band of frequencies and a high band of frequencies, not discussed herein. Impedance match may be achieved when the load (antenna) and the characteristic impedance of the transmission line delivering the signal to the antenna (or delivering the signal from the antenna) are matched. The load impedance (antenna) may terminate the transmission line in a matched or very low reflection (low return loss) condition. The overall system may be designed for efficient signal transmission or maximum power transfer, which may occur if all components attached to the transmission line are matched to the transmission line impedance. In one embodiment, the characteristic impedance may be 50Ω, nominal.

The following description and accompanying drawings provide adequate detail and sufficient explanation for the various aspects of the disclosed exemplary embodiment. Furthermore, these aspects provide an indication for a broad range of implementation methodologies which may have relatively equivalent results when attempting a variety of similar design implementation. Novel and advantageous features shall be either inferred or directly apparent from the study of this description and the associated drawings.

Details below are generally directed toward a top loaded monopole antenna that handles a lower band of frequencies and a higher band of frequencies. In particular, a top loaded monopole is disclosed that utilizes a resonator that enables a low band frequency (e.g., 700 MHz to 960 MHz) and a high band frequency (e.g., 1 GHz to 3 GHz) to be radiated and/or received. The lower resonator placement in connection with the top loaded monopole resonator allows receipt and/or transmission of a low frequency signal on the entire top loaded monopole antenna (e.g., radiator feed wire, upper top load radiator, down to the connector launch) structure. Moreover, the lower resonator section enables the top loaded monopole antenna to receive and/or transmit a high frequency signal above the lower resonator to the upper resonator portion of the top loaded monopole antenna based upon the electromagnetically coupled upper top load resonator matching an impedance in conjunction with the lower resonator portion of the top loaded monopole antenna; this high frequency signal is transmitted and/or received using all components from the top load radiator cap down to the antenna contact. The electromagnetically coupled top loaded monopole resonator and the lower resonator provide an antenna capable of receiving and/or transmitting dual bands of frequencies and in particular, a high frequency signal (e.g., above 1 GHz) and a low frequency signal (e.g., below 1 GHz). The resonator combination in conjunction with the electromagnetically coupled feed wire matches the impedance for low frequencies and high frequencies.

In a self-resonant structure, the assembly of the monopole antenna components may provide the means to match the transmission line impedance with the antenna (load) impedance without using any external feed circuit for such impedance matching. Thus, two resonators may be used with a quarter-wave monopole antenna, where the resonators (and other antenna components) are designed to match the impedances between the load (antenna) and transmission line for two separate frequency bands (high and low), and where the resonators (and other antenna components) are designed so that the two separate frequency bands may be sent or received without interference from each other. Both conductive and non-conductive (dielectric) components may affect the impedance matching. Non-conductive components may provide dielectric loading to the RF signal and may affect the signal by decreasing the wavelength of the signal, thus affecting the impedance match of the desired frequencies. A change in one component (such as dimensions of conductive components or materials of dielectric components) may often be compensated by changing another component to keep the total impedance matched.

The exemplary embodiment is described with reference to the drawings, wherein like reference numerals are used to refer to like elements throughout. In the following description, for purposes of explanation, numerous specific details are set forth in order to provide a thorough understanding of the subject innovation. It may be evident, however, that the exemplary embodiment may be practiced without these specific details.

Moreover, the word "exemplary" is used herein to mean serving as an example, instance, or illustration. Any aspect or design described herein as "exemplary" is not necessarily to be construed as preferred or advantageous over other aspects or designs.

FIG. 1 illustrates an antenna 100 that facilitates multiband communication. The antenna 100 can match impedance with a high frequency signal in order to provide dual band frequency operation with a low frequency signal below 1 GHz and a high frequency signal above 1 GHz. In particular, the antenna 100 can incorporate a conductive top load radiator cap 110 that enables dual band frequency operation within a low frequency (e.g., 700 MHz to 960 MHz) and a high frequency (e.g., 1 GHz to 3 GHz).

The antenna 100 can include an adaptive mechanical housing 130 that also provides electrical connectivity from an internal connector launch (referenced at 1500 in FIG. 15) to an upper radiator element (referenced at 340 in various Figures) housed within a non-conductive, dielectric support housing 120. Furthermore, the housed radiator feed element is terminated with top load radiator cap 110. The top load radiator cap 110 is electromagnetically coupled via a radiating/coupling feed wire such that the primary electrically conductive radiator components and the radiator cap 110 create a top loaded electromagnetically coupled monopole antenna structure.

Figure 2:
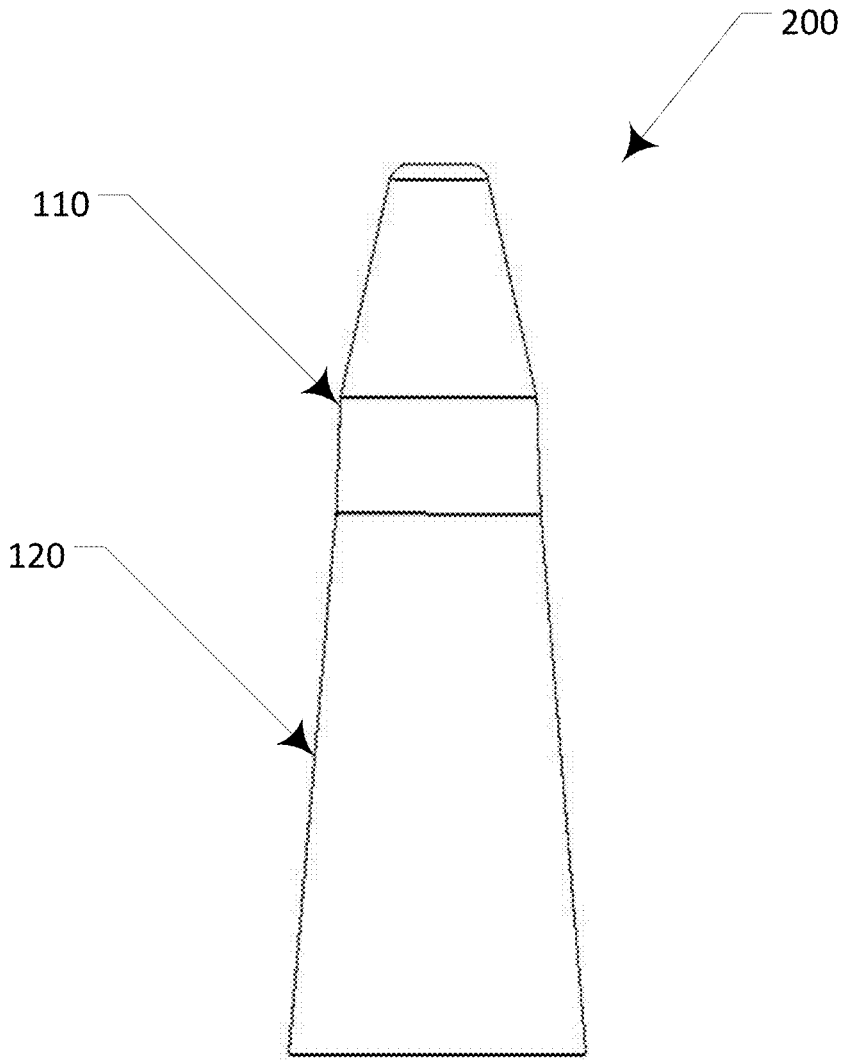
FIG. 2 is a front view of an upper resonating section of a monopole antenna including the radome enclosure.

FIG. 2 illustrates an upper section 200 of the monopole antenna 100. The dielectric support housing 120 can contain and protect electrically conductive radiator components. The dielectric support housing 120 can be mechanically coupled to the top load radiator cap 110.

Figure 3:
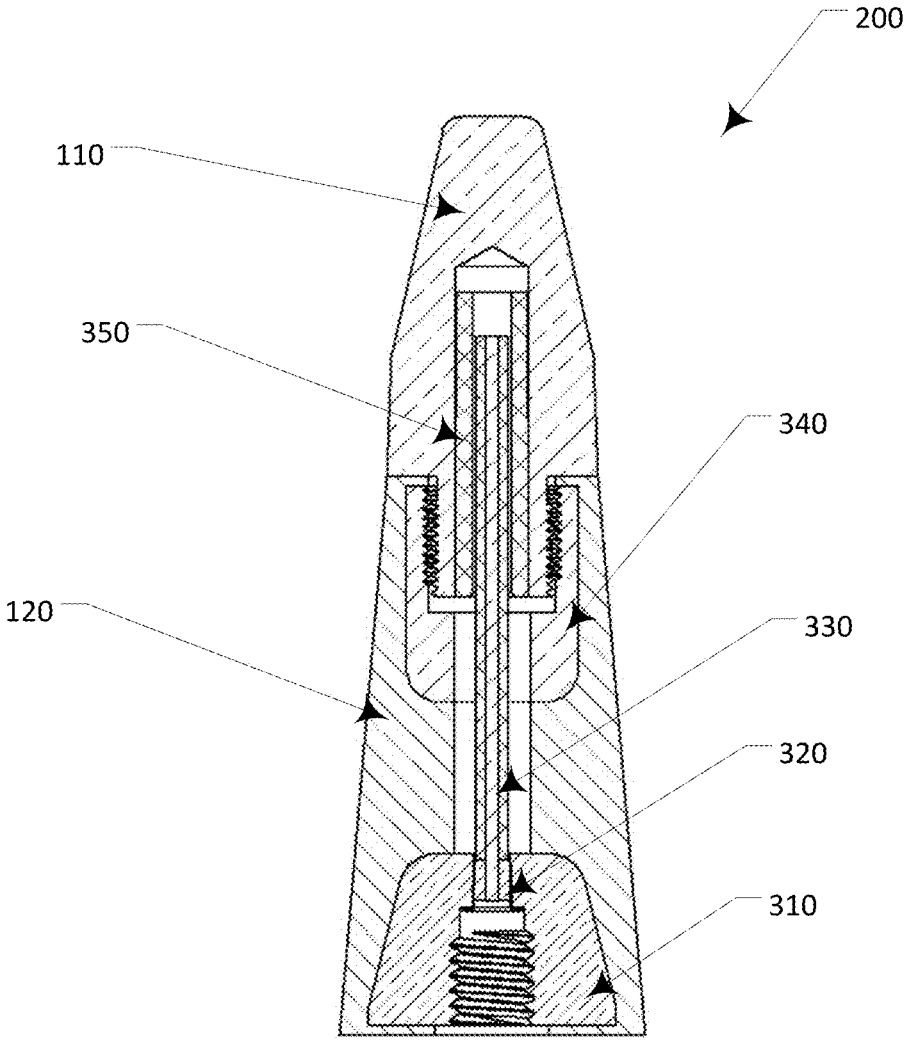
FIG. 3 is a cross-sectional view of the upper resonating section shown in FIG. 2.

FIG. 3 illustrates the cross sectional view of an upper section 200 of a monopole antenna 100. A lower resonator 310 can provide electrically conductive radiator elements of the antenna 100 with RF/Microwave current. The lower resonator 310 is mechanically bonded within the dielectric support housing 120 which together can form an integral mechanical foundation to support the upper section 200 of the antenna 100. A feed wire 330 can be directly coupled to the lower resonator 310 by means of an electrically conductive eyelet type fastener 320.

The feed wire 330 can be electrically bonded with the electrically conductive eyelet fastener 320 by use of a conductive bonding agent such as solder or other electromechanical means. The feed wire 330 can operate as a sub-component of the overall monopole radiator by defining a pathway for RF/Microwave current between a lower resonator 310 and the top load radiator cap 110. A dielectric insulator 350 provides direct current isolation between feed wire 330 and the top load radiator cap 110. Alternatively, RF/Microwave current coupling can be optimized between feed wire 330 and top load radiator cap 110 by choosing the appropriate inner-diameter/outer-diameter (ID/OD) relationship for the top load radiator cap 110 and the feed wire 330. For the exemplary embodiment, the ID/OD relationship can be implemented in the range of 4.0 to 8.0 using a properly chosen material dielectric insulator 350 with dielectric constant in the range of 2.0-6.0. This particular design exemplifies an ID/OD ratio of approximately 5.75 with a dielectric constant of approximately 3.5-3.7 which can be machined from, for example, Polyoxymethylene (POM) material (also referred to as Delrin™) Additionally, feed wire 330 can be implemented using a single or twisted multi-conductor strand of wire with the required diameter. For this example, a standard AWG 18 wire, stranded, is implemented with a PVC insulation coating. This innovation does not require a PVC insulation, but merely exhibits a practical and suitable wire type for implementation. Furthermore, feed wire 330 does not require a directly applied insulated coating to achieve the performance. Feed wire 330 can be implemented in a large variety of means, including no insulation or a sleeved component, fabricated in a tubular manner that is assembled by insertion of the wire into the tubular dielectric sleeve. Top load radiator cap 110 in conjunction with lower sub-section top load resonator 340 can form the totality of the conductive portion of the electromagnetically coupled top load monopole resonator.

The antenna 100 allows simultaneous transmission and reception of a high frequency signal and a low frequency signal based upon a broadband impedance match provided by the combination of the top load radiator cap 110 and the lower resonator 310, coupled together by feed wire 330. This lower resonator 310-top load radiator cap 110 combination supports half wave radiation due to the nature of the shape, geometry and location on the antenna 100. The lower resonator 310 can deliver current to the feed wire 330 where it is further routed to the top load radiator cap 110 by means of electromagnetic coupling. For a high frequency signal, the upper section 200 of the monopole antenna 100 resonates because of the half-wave length resonance that is achieved between the top load radiator cap 110 and the lower resonator section 310 of the antenna 100. In particular, the top load radiator cap 110 can match impedance for a high frequency signal and a low frequency signal simultaneously, allowing the transmission and reception of high frequency signals without any interference from low band frequencies. The lower resonator 310 matches the impedance for the top load radiator cap 110 (e.g., the upper portion 200 of the top loaded monopole antenna 100). Moreover, the combination of the lower resonator 310 and top load radiator cap 110 can also match impedance for an antenna mount (such as an NMO mount referenced at 1500 in FIG. 15). The lower resonator 310 can match impedance for the antenna mount in conjunction with the top load radiator cap 110 based upon the composite structure of the assembly and size of the upper monopole section 200, and the dielectric materials utilized with a dielectric (or radome) housing 120 structurally supporting and encasing the feed wire 330, the lower resonator 310 and the upper resonator 340 within the antenna 100. Thus, the quarter-wave monopole may operate at the lower frequencies, whereas the higher frequencies may operate with half-wave characteristics.

For example, a conventional dual frequency technique utilizes a choke that attempts to diminish or eliminate current flow to an upper portion of a radiator or top loaded monopole antenna. However, such techniques do not completely eliminate the current and a leakage of current exists which can degrade the performance of the dual band frequency receiving and/or transmission properties of the radiator or monopole antenna. Yet, by utilizing the lower resonator 310 with the top radiator cap 110 and the feed wire 330, as structurally supported with radome housing enclosure 120, an impedance of the radiator cap 110 can be matched to allow for radiation and/or receipt of high frequency signals without interference from a low band of frequency signals. In particular, the lower resonator 310 can establish a matched condition where both the high and low frequency signals coexist simultaneously, where the high frequency signal resides between the lower resonator 310 and the top load radiator cap 110 and the low frequency signal resides between the top load radiator cap 110 and the contact feed point of the antenna 100 (referenced at 1510 in FIG. 15).

The exemplary embodiment includes the lower resonator 310 which is attached to the primary conductor/radiator (e.g., feed wire 330). The lower resonator 310 provides for an optimal feed point impedance match and current flow to the upper portion of the feed wire/radiator element 330 and top load radiator cap 110, where approximate half wavelength resonance and radiation is achieved. Conventional techniques typically attempt to diminish or eliminate current with a choke-like device but the present inventor has perceived that current is not completely eliminated. The exemplary embodiment employs the lower resonator 310 to allow current to pass to the feed wire 330 and top load radiator cap 110 enabling multi-frequency capabilities.

The exemplary embodiment can accommodate broad, dual band operation. The antenna 100 can be configured to operate across an extended broad range of frequencies in the lower band region and conjunctively in a higher frequency band, such as approximately double the frequency of the lower band. For example, a configuration can include a simultaneous operation in a dual band mode operating in the vicinity of approximately 850 MHz and approximately 1900 MHz. In general, the antenna 100 can operate in a low frequency band (e.g., 700 MHz to 960 MHz) and a high frequency band (e.g., 1 GHz to 2.5 GHz).

Quarter-wave monopole structures are typically designed for broad, single band operation and can be implemented across the lower band of interest, approximately 700 MHz to 960 MHz. This lower band, broad range of frequencies, encompasses many mobile radio bands and applications, making the typical broad band quarter-wave used for broad or multi-band systems, where the range of frequencies are nearly continuous (e.g., narrow band gaps only) and relatively close together within the Radio Frequency (RF) spectrum. The antenna 100 operates across a broad range of closely spaced bands (698 MHz to 960 MHz) including operation at a higher band (1575 MHz to 2500 MHz), where several mobile radio systems are operated by carriers who own spectrum in both the lower and upper bands of interest.

The antenna 100 can achieve desirable performance by incorporation of a lower resonator device (e.g., lower resonator 310) that augments a dual resonant impedance match with highly efficient radiation characteristics in both the lower and upper bands of interest. The lower resonator 310 performs conjunctively with the top load radiator cap 110 that is attached to the radome enclosure, augmenting an electromagnetically coupled conductive radiator, providing optimized impedance match for the upper band of frequencies while simultaneously providing optimized impedance match for the lower band of frequencies. Additionally, the lower resonator 310 provides support for approximate half-wave radiation characteristics in the upper band of frequencies while not requiring a ground plane (which is required for typical quarter-wave monopole implementation). The antenna 100 radiates efficiently within the lower band of frequencies and is dependent upon the top load radiator cap 110 to provide support for the quarter-wave radiation characteristics in the lower band of frequencies. The lower frequency bands can remain ground plane dependent.

Additionally, the antenna 100 is optimized for impedance matching with traditional antenna mounts (e.g., NMO mount such as referenced at 1500 in FIG. 15) widely used and accepted throughout the mobile radio industry, whereas such traditional mounts have proved difficult to impedance match in dual band modes including operational frequencies above 1000 MHz (e.g., 1 GHz).

Figure 4:
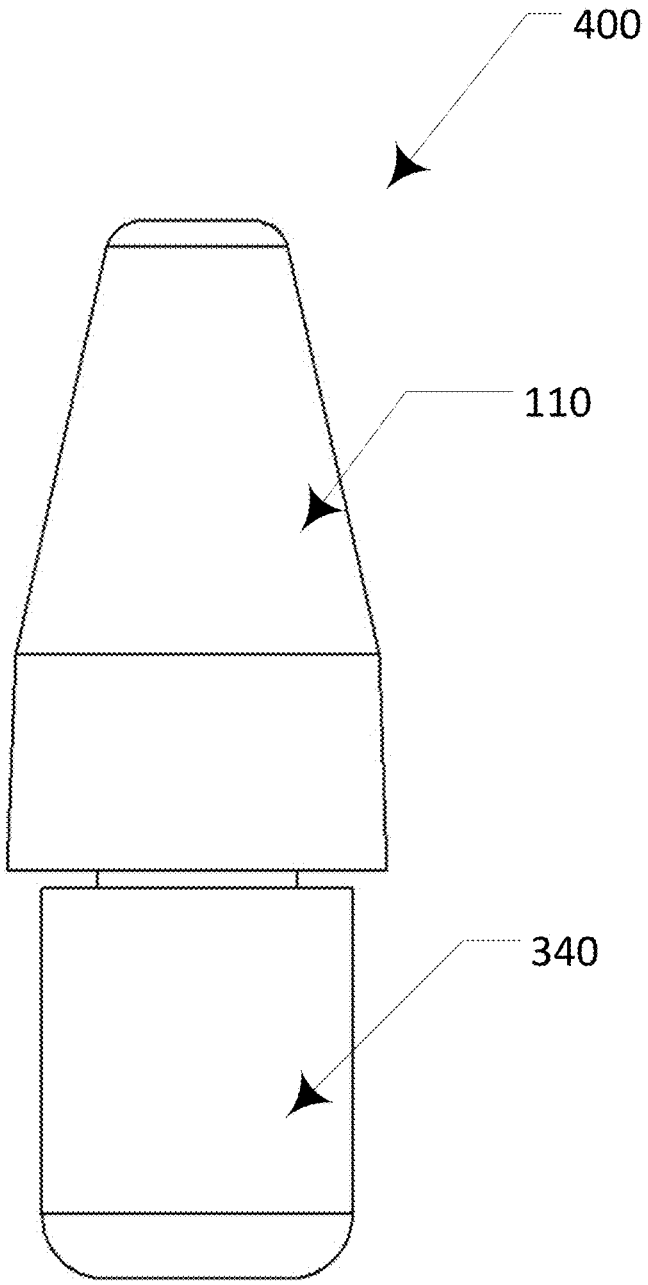
FIG. 4 is a front view of a top load resonator sub-assembly of a monopole antenna.

FIG. 4 illustrates the totality of the top load resonator assembly 400. The top load resonator assembly 400 is comprised of two electrically conductive elements joined together mechanically by conductive threaded interface (not shown). The top load resonator assembly 400 consists of the top load resonator 340 and the top load radiator cap 110. The top load resonator assembly 400 provides for the traditionally known top loading of the top load monopole. The top load resonator 340 can be fabricated with many variations of conductive brass or brass plated, copper alloy and/or any other suitable material related to primary conductive elements. For the exemplary embodiment, the top load resonator 340 can be fabricated from a brass alloy with outer surfaces primed with a bonding agent to make them more suitable for adhesion with the injection molded polymer dielectric material that forms the antenna dielectric, radome housing 120. The top load radiator cap 110 can be fabricated from a similar brass alloy composition and can be finished with any suitable, environmentally protected finish to resist exposure to environmental conditions. For the exemplary embodiment, the top load radiator cap 110 can incorporate a black chrome type finish to provide a relatively high conductivity surface with aesthetic appearance features to reduce visual impact. The top load resonator assembly 400 can provide for top load monopole characteristic for broad band electrical performance and physically low profile aesthetic characteristics. The top load resonator assembly 400 can function in unison with the feed wire 330 and the lower resonator 310 to provide the overall electrical current flow and radiation characteristics for both 700 to 900 MHz and 1500 to 2500 MHz frequency bands.

Figure 5:
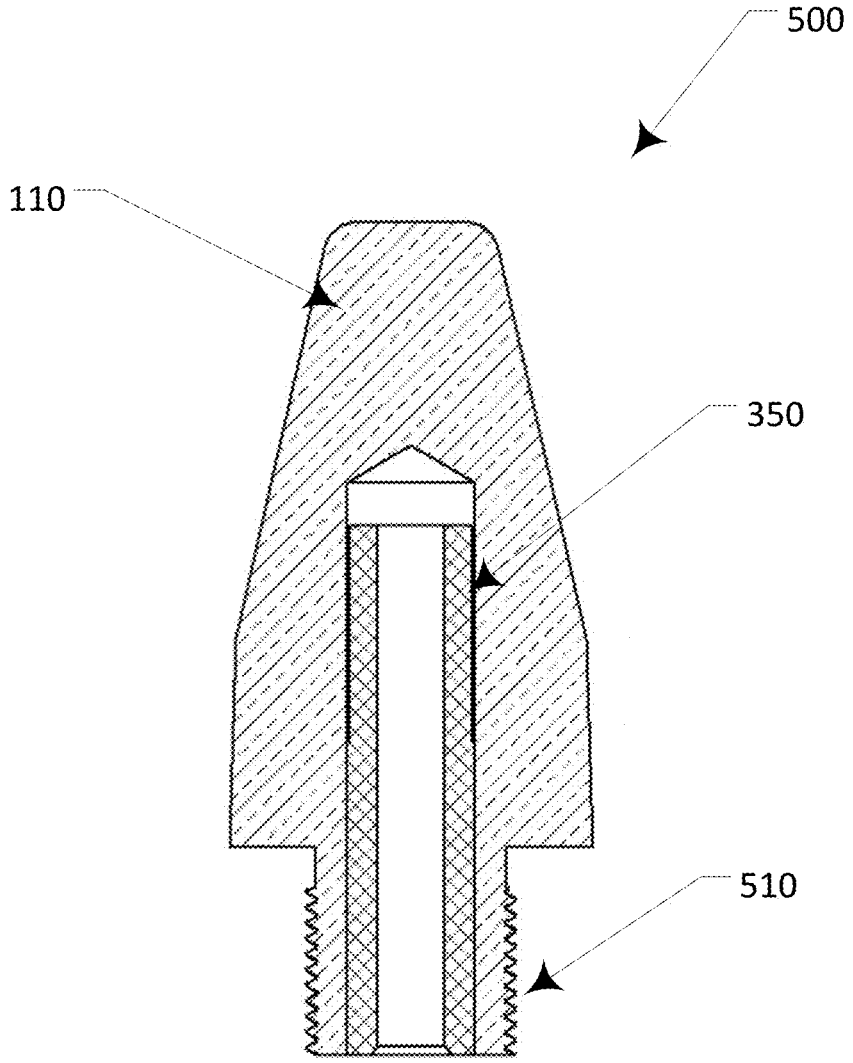
FIG. 5 is a cross-sectional view of a top loaded resonator sub-assembly, including an isolating dielectric insulator that facilitates an electromagnetic coupling aperture.

FIG. 5 illustrates a top load radiator cap assembly 500 which incorporates the dielectric insulator 350. Dielectric insulator 350 resides within the interior diameter (or hollow portion) 520 of the top load radiator cap 110 and provides a means of direct current isolation between feed wire 330 and the top load radiator cap 110, while providing optimization for the electromagnetic coupling between feed wire 330 and top load radiator cap 110. In the exemplary embodiment, a mechanical press fit relationship can be defined between the top load radiator cap 110 and the dielectric insulator, and does not preclude the assembly of the two parts from being mechanically configured with other bonding or mechanical fastening. Dielectric insulator 350 maintains a concentrically positioned relationship between the feed wire 330 outside diameter and top load radiator cap 110 inside diameter. It is well understood by those skilled in the art of design and implementation for electromagnetic coupling devices to provide for the required component tolerances and spatial positioning necessary to maintain the required performance objectives. The dielectric insulator 350 material can be chosen to provide high strength material properties augmenting a press fit assembly with top load radiator cap 110 while maintaining a smooth low friction interior surface to permit a sliding interface with feed wire 330. The sliding interface can permit the antenna radome housing 120 to perform with mechanical flexibility while permitting the feed wire 330 and dielectric insulator 350 to adjust under load impact and temporary or momentary deformation of the antenna radome housing 120. The dielectric insulator 350 material chosen for the exemplary embodiment consists of Polyoxymethylene (POM) material (also referred to as Delrin™), with approximately a dielectric constant of 3.5-3.7. Furthermore, the cross sectional wall thickness directly accommodates the required ID/OD relationship between the ID of the top load radiator cap 110 and the OD of the feed wire 330. For the exemplary embodiment the wall thickness is approximately 1.5 mm. A variety of dielectric insulator materials can be used for the implementation of the antenna 100 and can range in dielectric constant values greater than 1.0, depending upon the feed wire 330 outer diameter and top load radiator cap 110 inner diameter chosen for implementation. Furthermore, specific low and high frequency bands required for implementation will tend to indicate the exact material dielectric required to achieve the necessary electromagnetic coupling.

Figure 5A:
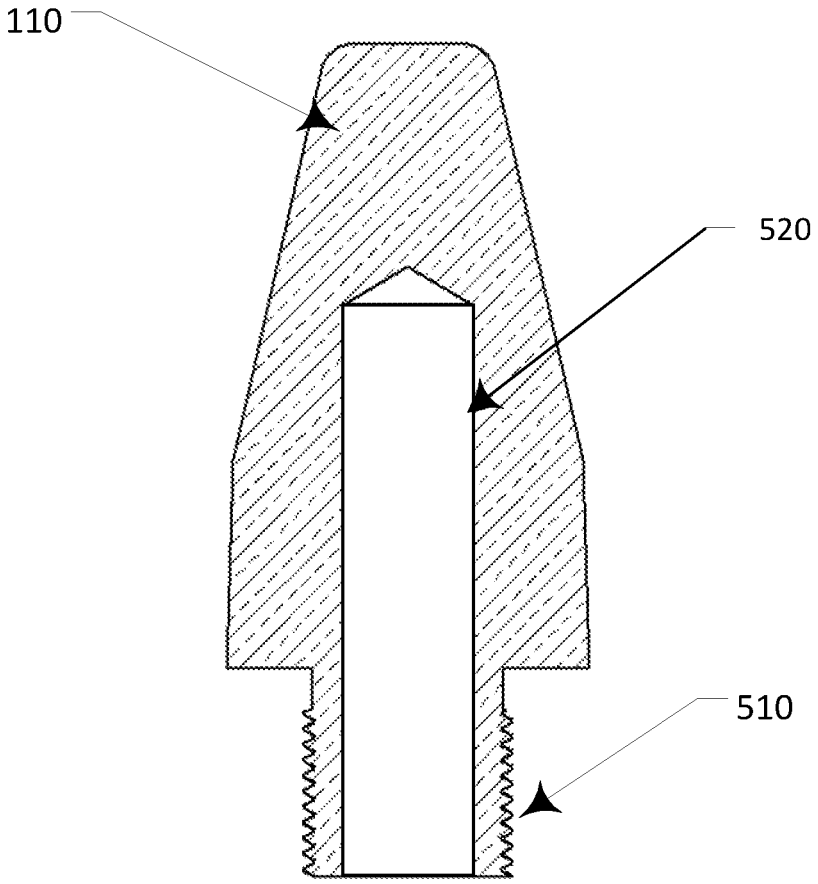
FIG. 5A is a cross-sectional view of the top loaded resonator sub-assembly of FIG. 5 without the dielectric insulator.

FIG. 5A illustrates the top load radiator cap assembly of FIG. 5 before the dielectric insulator 350 is incorporated into the interior diameter or hollow portion 520 of the top load radiator cap 110.

Figure 6:
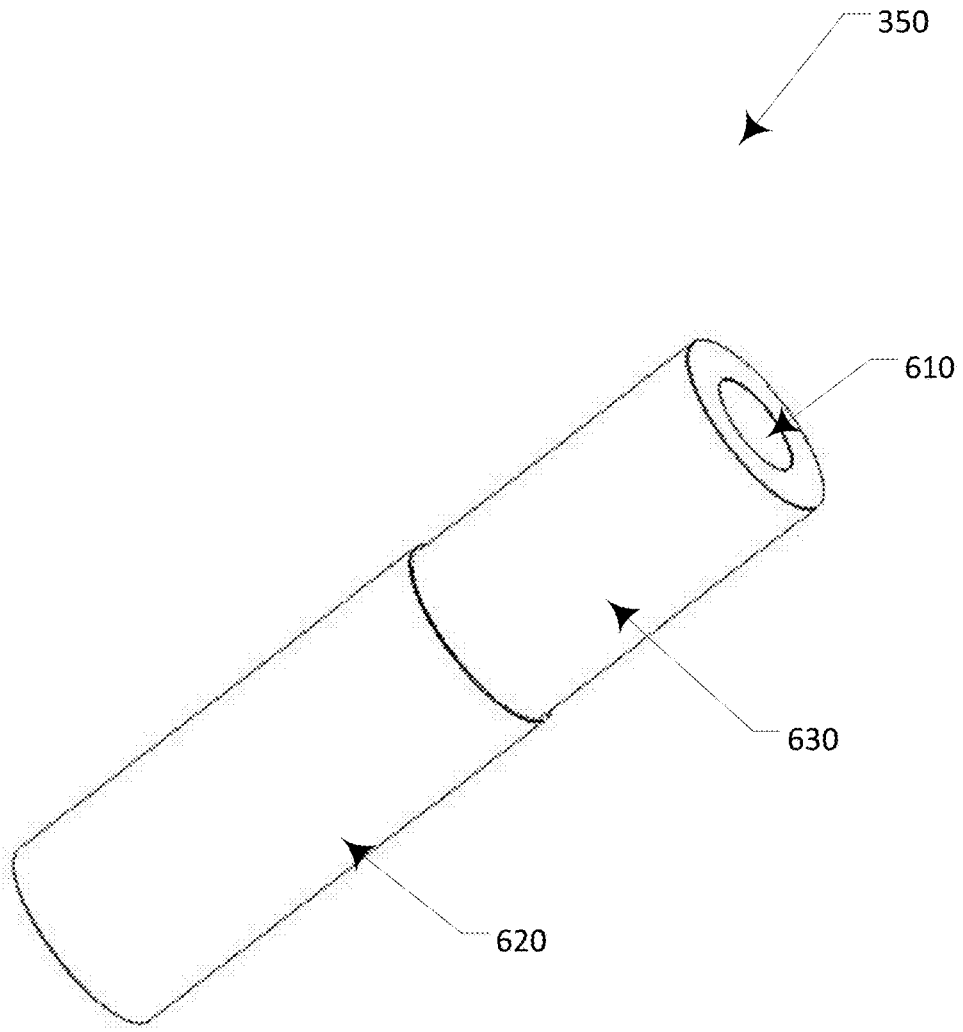
FIG. 6 is an isometric view of an isolating dielectric insulator that facilitates an electromagnetic coupling aperture.
Figure 7:
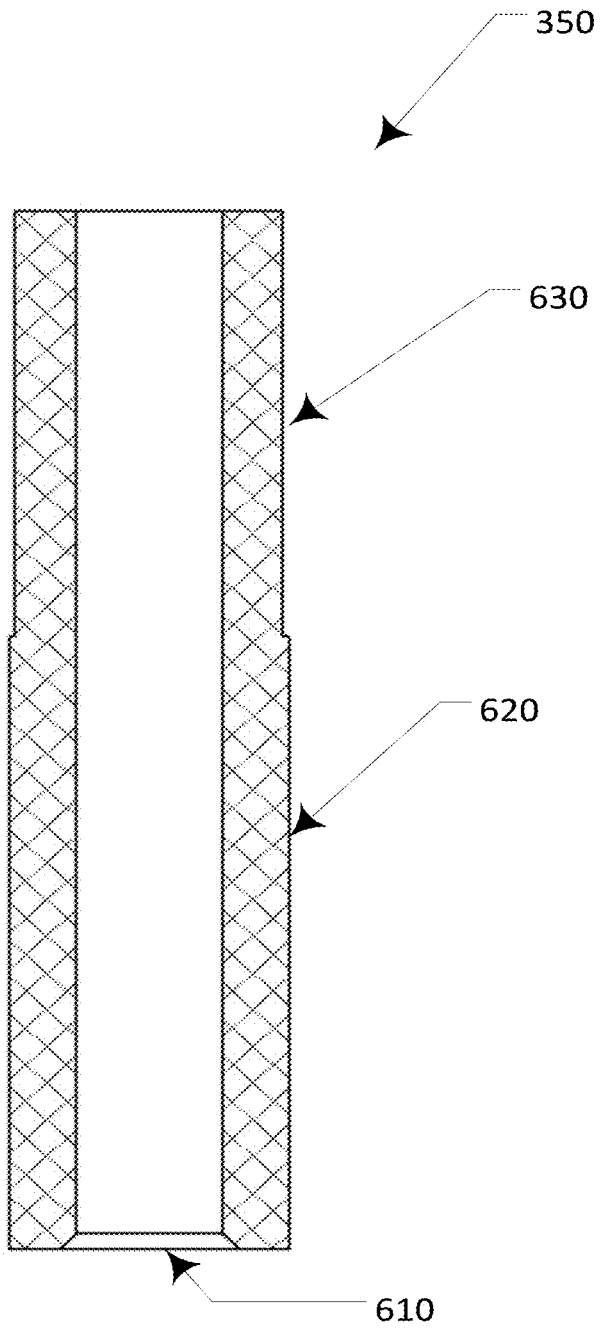
FIG. 7 is a cross-sectional view of an isolating dielectric insulator that facilitates an electromagnetic coupling aperture.

FIG. 6 illustrates an isometric view of the dielectric insulator 350. FIG. 7 illustrates a cross section view of dielectric insulator 350, which may be an insulator tube 350. The dielectric insulator is constructed from commonly known dielectric insulating materials in a tubular pipe shape as shown, with an aperture 610 and an outer surface 620. The diameter of aperture 610 can be chosen to provide for a sliding fit with feed wire 330. The diameter of the outer surface 620 can be chosen to interface and define a press fit with the inside diameter of top load radiator cap 110. The diameter of the outer surface 630 can be chosen to interface and define a clearance fit with the inside diameter of top load radiator cap 110.

Figure 8:
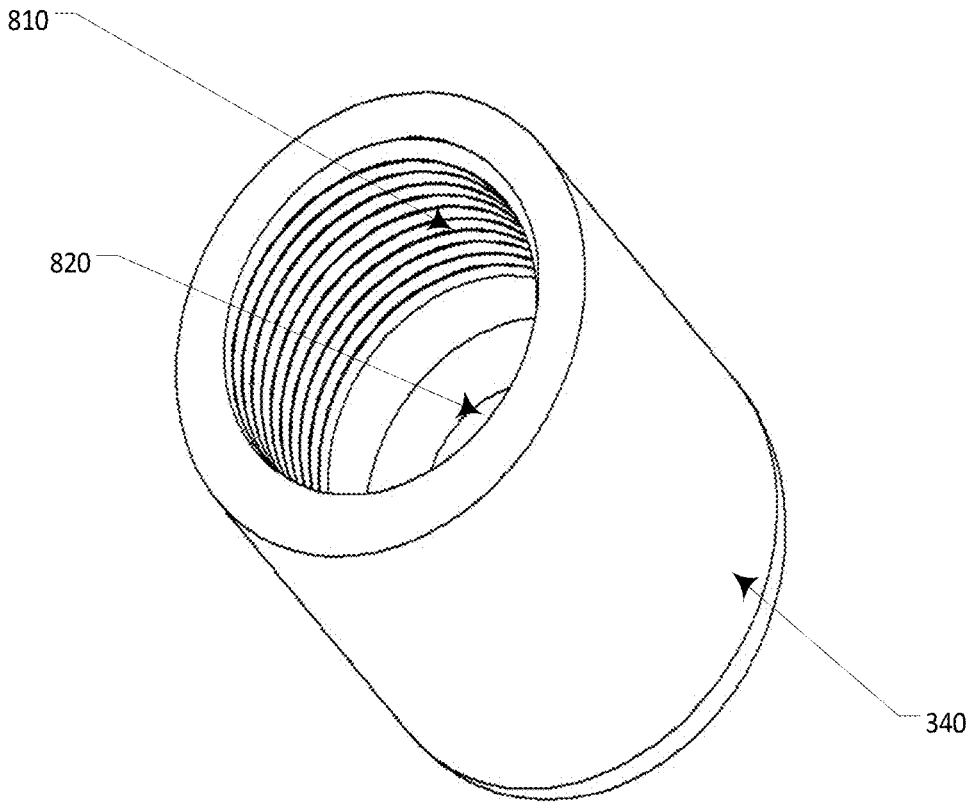
FIG. 8 is an isometric view of a lower section of a top load monopole resonator sub-assembly.
Figure 9:
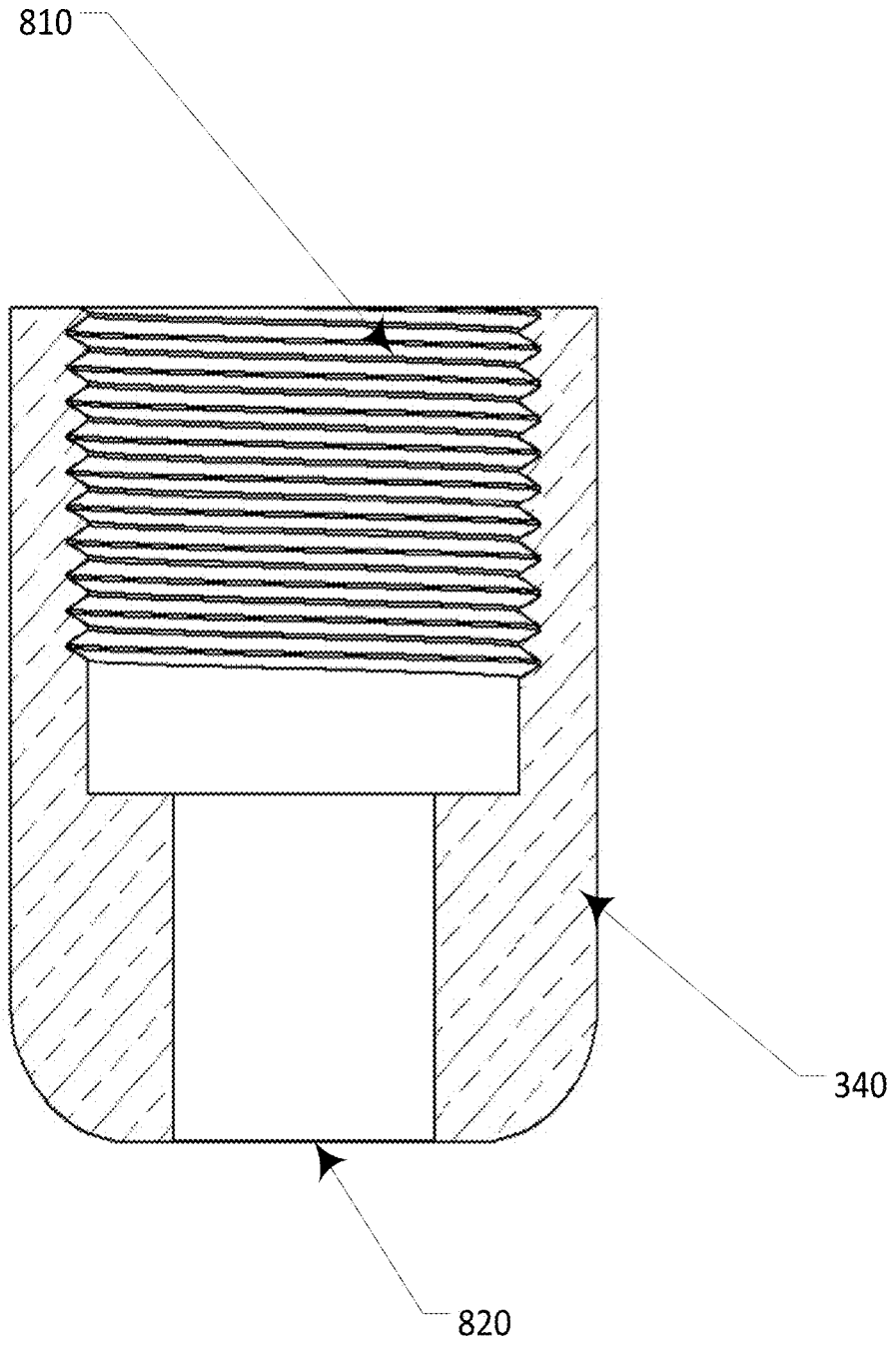
FIG. 9 is a cross-sectional view of a lower section of a top load monopole resonator sub-assembly.

FIG. 8 illustrates an isometric view of the top load resonator 340. FIG. 9 illustrates a cross section view of top load resonator 340. The top load resonator 340 can include an interior coupling threaded surface 810. The top load resonator 340 can also include an access clearance aperture 820 for receiving the feed wire 330. The threaded coupling surface 810 can be desirable in that it can provide for firm mechanical coupling for the top load radiator cap 110 while also providing an electrically conductive junction between top load radiator cap 110 and the top load resonator 340. The diameter of the aperture 820 can be selected to provide access for insertion of the feed wire 330, permitting the feed wire 330 to pass through and into the top load radiator cap assembly 500.

Figure 10:
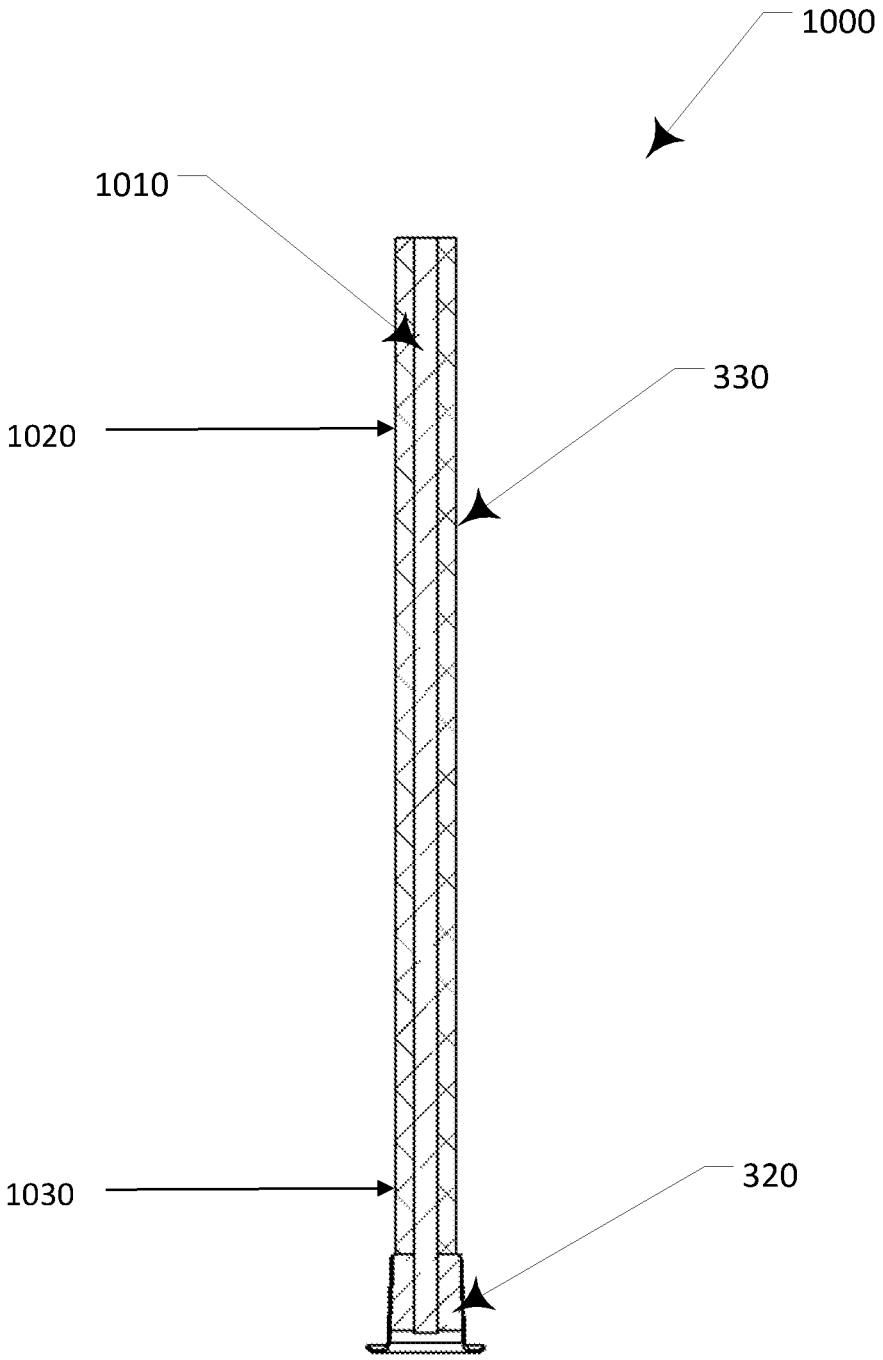
FIG. 10 is a cross-sectional view of a feed wire assembly that electrically couples the lower monopole resonator sub-assembly to the upper top load monopole resonator sub-assembly.

FIG. 10 illustrates feed wire assembly 1000 comprised of feed wire 330 and conductive eyelet 320. Conductive eyelet 320 is electrically and mechanically bonded to feed wire 330 and provides the primary means of conducting RF current from the lower resonator 310 to the upper load resonator 340 and therefore to top load radiator cap 110. The feed wire assembly 1000 is a conductive element, supporting current flow and radiation for both the lower frequency bands and higher frequency bands. By way of example and not limitation, the feed wire 330 can be conductively plated brass, copper alloy, and/or any other suitable material related to primary conductive elements. Furthermore, the conductor 1010 of the feed wire 330 can be coated or insulated with a variety of insulating dielectric materials. For the exemplary embodiment, the feed wire 330 incorporates a PVC coating integral to the manufacture of commonly used 18 AWG stranded wire. The feed wire/radiator element 330 may include an upper portion 1020 and a lower portion 1030. In the exemplary embodiment, the electro-mechanical bonding between feed wire 330 and conductive eyelet 320 can be achieved using commonly known solder and soldering processes.

The length of feed wire assembly 1000 can be selected in view of the proper resonances required to receive and transmit the described lower 700-960 MHz and higher 1500-2500 MHz frequency bands. The feed wire assembly 1000 can be varied in length dimension in order to achieve the proper electromagnetic coupling required between feed wire 330 and top load radiator cap 110. To implement the exemplary embodiment for example, the feed wire assembly 1000 overall length can be chosen to be in the range of 46-50 mm to achieve a desirable impedance match for the lower frequency bands of 700-960 MHz and the higher frequency bands 1500-2500 MHz. Additionally, variations in the feed wire length can also achieve similar results by those skilled in the art, and are dependent upon the complementary primary conductive components which can include, but may not be limited to include the top load radiator assembly 400, lower resonator 310 and the radome housing 120 with relative dielectric constant in the range of 3.5-3.7. To further explain, an optimal impedance match is obtained by first choosing fixed length and diameter dimensions for lower resonator 310 and top load resonator 340. Furthermore, the distance of separation between lower resonator 310 and top load resonator 340 is chosen to be fixed in order to achieve the desired impedance and radiation characteristics of the embodiment. For the described invention, the dimensional spacing between lower resonator 310 and top load resonator 340 is chosen to be approximately 13.08 mm. Additionally, the cylindrically shaped top load resonator length is chosen to be approximately 17.98 mm with a diameter of approximately 14.3 mm, representing a L/D ratio of approximately 1.26. Furthermore, the conically shaped lower resonator 310 is dimensioned to provide a length of approximately 14.3 mm with a major diameter of approximately 20.5 mm and minor diameter of 14.3 mm. The respective L/D ratios are nominally 0.7 for the major diameter surface and nominally 1.0 for the minor diameter surface of the lower resonator 310. To achieve the required impedance match for the stated dual frequency bands of interest, specifically 700-960 MHz and 1500-2500 MHz range, the top load radiator cap 110 may be chosen to have an approximate length of 29.97 mm (not including the mechanically threaded interface region 510 of the top load radiator cap 110), extending the overall length of the top load resonator assembly 400 to a nominal total assembled length of approximately 48.77 mm. The shape factor of the top load radiator cap 110, top load resonator 340 and lower resonator 310 can be chosen to be any shape deemed functionally acceptable by those skilled in the art. With top load resonator assembly 400 and lower resonator 310 dimensions selected, and considering that radome housing 120 material is chosen with relative dielectric constant in the range of 3.5-3.7, the length of the feed wire assembly 1000 is determined by increasing or decreasing the length of the feed wire 330 to augment the required electromagnetic coupling between the feed wire 1000 and the top load radiator assembly 400 until the desired impedance match is obtained for both bands of interest, namely 700-960 MHz and 1500-2500 MHz. The impedance match optimization methodology is well understood by those skilled in the art.

Figure 11:
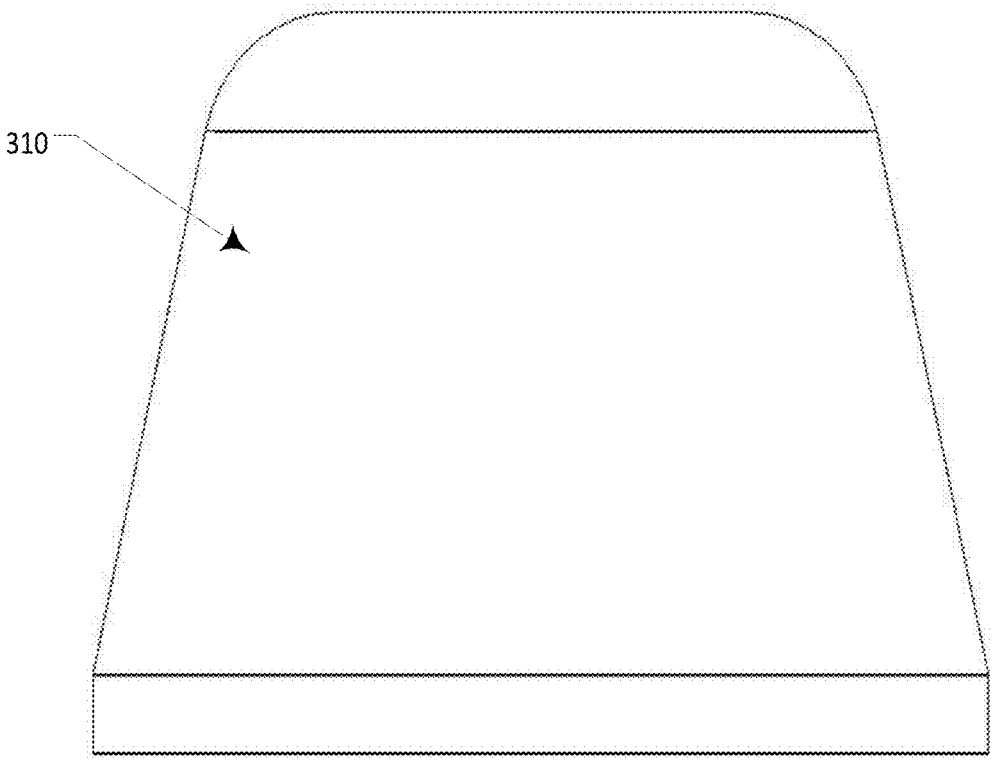
FIG. 11 is a front view of a lower resonating section of a top load monopole antenna.

FIG. 11 is a front view of the lower resonator 310. The lower resonator 310 is a sub-component of the antenna 100 and can be comprised of materials suitable for conducting RF/Microwave currents. The lower resonator 310 can be formed from a brass alloy. Other suitable materials may include copper, copper plated alloys and any other materials appropriate for the conduction of RF/Microwave currents available to those skilled in the art.

Figure 12:
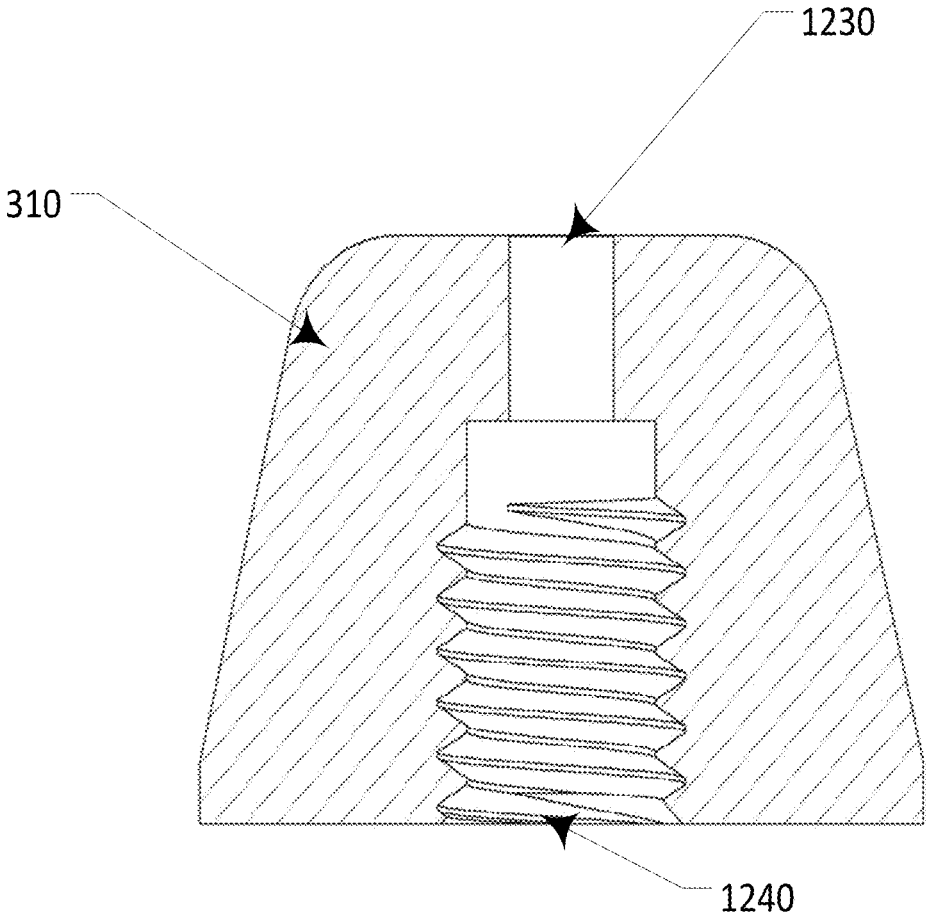
FIG. 12 is a cross-sectional view of a lower resonating section of a top load monopole antenna.

FIG. 12 is a cross-section of the lower resonator 310. The lower resonator 310 can provide electrical conductivity between the contact adapter 1410 (shown in FIG. 14) and the feed wire assembly 1000. The lower resonator 310 is a sub-component of the primary electrical conductor and can provide RF/Microwave current to the feed wire assembly 1000 by means of direct mechanical attachment with conductive eyelet 320, establishing electrical contact and augmenting current flow from the lower resonator 310 to the feed wire assembly 1000. In the exemplary embodiment, a mechanical press fit can be defined between the conductive eyelet 320 and an aperture 1230 of the lower resonator 310. Mechanical attachment of the lower resonator 310 to an adaptive housing 130 (shown in FIG. 14) can be accomplished by threading engagement between a threaded aperture 1240 and the threaded contact adapter 1410. For the exemplary embodiment, this threaded interface can be standard ¼"-20 Unified National Course (UNC) thread. Any other suitable mechanical interfaces may be incorporated to accomplish a mechanical attachment while providing electrical conductivity from the contact adapter 1410 to the lower resonator 310. Furthermore, the lower resonator 310 can be an integral mechanical component of the antenna radome housing 120, such as by means of an insert molding process. Other means of component integration can be easily implemented by those skilled in the art.

Figure 13:
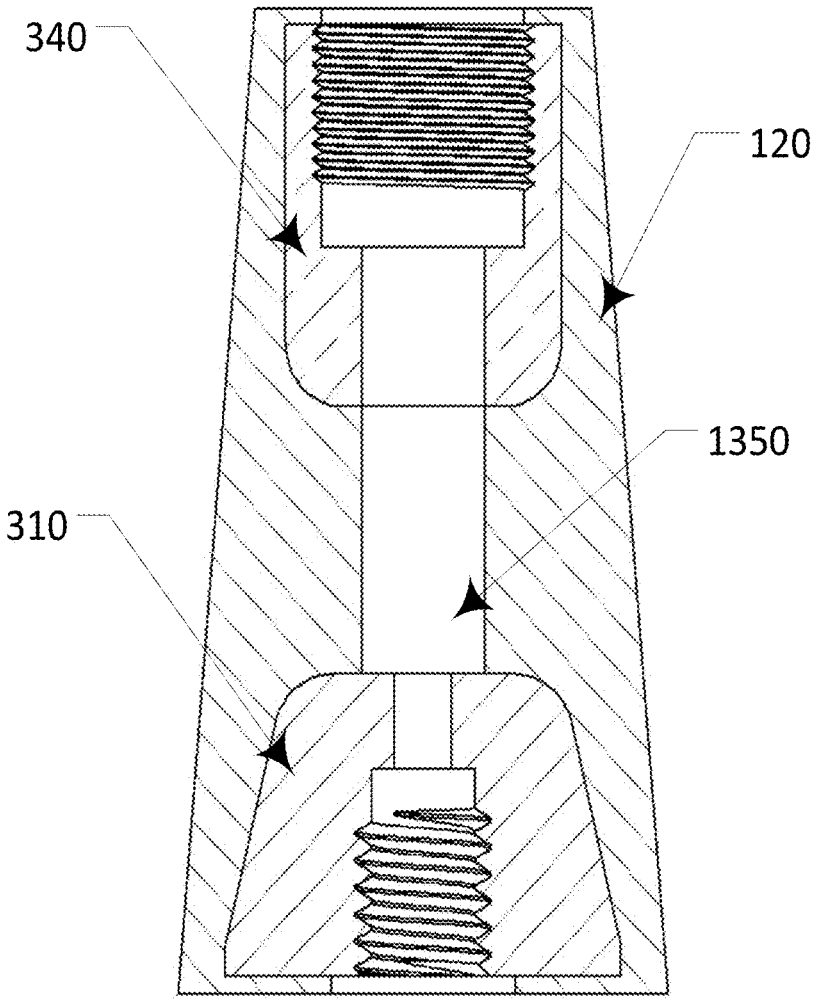
FIG. 13 is a cross-sectional view of a structural dielectric enclosure with embedded primary conductors comprised of a lower resonator and a top load resonator.

FIG. 13 is a cross-section of the antenna radome housing 120. The antenna radome housing 120 contributes the simultaneous transmission and/or reception of dual band frequencies. In particular, the antenna radome housing 120 allows a low frequency and a high frequency to be radiated and/or received without interference between the two bands. For example, the antenna radome housing 120 can handle a low frequency between 700 MHz to 900 MHz (e.g., low frequency) as well as a high frequency above 1 GHz (e.g., 1 GHz to 2.5 GHz). The antenna radome housing 120 is formed of a non-conductive dielectric with material properties permitting the efficient reception and transmission of dual band frequencies. Furthermore, the antenna radome housing 120 provides structural support and isolation from environmental conditions that can render the monopole antenna 100 inoperable due to water or other foreign matter ingress that can disrupt or eliminate the dual band frequency currents from flowing and radiating efficiently along the conductive feed and radiator elements within the upper section 200. The housing 120 thus provides mechanical support and environmental protection for the primary electrically conductive monopole resonator components. Additionally, the exemplary embodiment can utilize a flexible or resilient elastomeric polymer material for radome housing 120 that permits for antenna flexibility and resistance to impact from foreign objects at high speeds. The flexible radome housing 120 augments impact resistance by permitting the monopole radiator aperture to flex under mechanical load while maintaining reliable signal transmission and reception properties. The elastomeric polymer material can be made from a wide variety of flexible polymers including, but not limited to rubber, polyurethane and many alloys of similar material characteristics known by those skilled in the art of design, fabrication and implementation of similar polymer dielectric materials. One or more components of the exemplary embodiment can be formed from polymer materials with an approximate dielectric constant of 3.5 and can be implemented across a wide range of dielectric constants from approximately 1.2 and higher by those skilled in the art of implementing dielectric materials. The interior shape of the antenna radome housing 120 can reflect the precise shape of the exterior surfaces of the lower resonator 310 and the upper resonator 340 to accommodate bonding the associated interfacing surfaces within the interior of the antenna radome housing 120. Bonding can be achieved in several ways in various embodiment, such as by incorporating adhesives, epoxies or other bonding agents to create adhesion between the surfaces. Components can also be molded together using a method of insert molding processes that incorporate bonding agents applied to the conductive surfaces of the lower resonator 310 and upper resonator 340 which enhance the bonding process resulting in a common assembly of the two resonator parts bonded together, but separated by the polymer dielectric material described as antenna radome housing 120. The two resonators 310, 340 can be separated by a predetermined distance and accessible to one another for future assembly via a small cylindrical cavity 1350 adjoining the lower resonator 310 and upper resonator 340. The hollow cylinder formed from the injection molding process provides a pathway for feed wire 330 insertion, electrically joining the lower resonator 310 and upper resonator 340.

Figure 14:
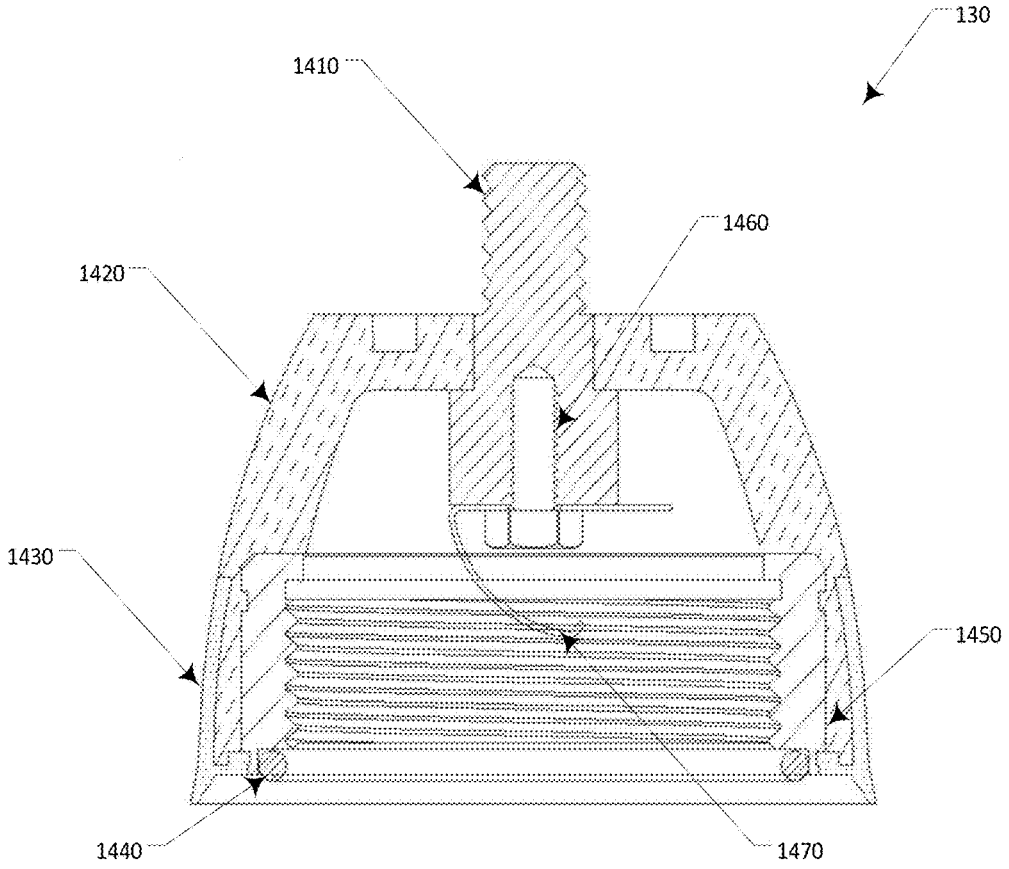
FIG. 14 is a cross-sectional view of an adaptive housing, NMO antenna mount type, used to provide an electrically conductive means between the primary electrically conductive monopole resonator components and the NMO connector.

FIG. 14 is a cross-section of the adaptive housing 130. The adaptive housing 130 is comprised of a rigid dielectric insulator support structure 1420 and a semi-rigid dielectric support insulator 1430. The contact adapter 1410 provides the initial primary conductive path for RF current to begin flowing from a contact 1470 into the lower resonator 310. The contact adapter 1410 is held in position with firm mechanical attachment providing for a strong mechanical support of upper monopole section 200. For the exemplary embodiment, the contact adapter 1410 is inserted as part of an injection molded process. Furthermore, the injection molded process establishes the formation of rigid dielectric insulator support structure 1420 which can be formed from a variety of thermoplastic or other rigid dielectric materials. The adaptive housing 130 can also be fabricated using commonly known machining methods where associated components such as contact adapter 1410 can be attached through various mechanical assembly means. Semi-rigid dielectric insulator 1430 provides for an aesthetic surface and can function with a dual role as a grip feature to augment ease in handling during installation of the adaptive housing 130 to the mounting surface of the device (not shown). Additionally, the semi-rigid dielectric insulator 1430 can provide for properly chosen thermoplastic vulcanizate material known to those skilled in the art as "TPV" which aid in the aesthetic appearance and overall performance of the installation by filling the spatial air gap as a dust or debris seal between the adaptive housing 130 and the mounting surface (not shown) of the device. Other materials can also be incorporated in place of the TPV using TPU (Thermoplastic Polyurethane) with similar properties in texture and durometer. Each material type exhibits unique thermal, mechanical and chemical resistance properties suitable for such applications.

Additionally, adaptive housing 130 can provide an environmental enclosure for the electrical contact launch for the antenna 100. The contact 1470 can be the initial electrical conductive feed point for the antenna 100, wherein the contact 1470 can be comprised of a resilient conductively plated brass copper alloy providing a high degree of mechanical spring-like retention between the antenna mount contact pin (not shown) and the primary conducting lower resonator 310. A hex cap screw 1460 can provide mechanical attachment and ensures continuous electrical conductivity between the contact 1470 and the radiator lower resonator 310 (shown above) via mechanical threaded connection to the contact adapter 1410. The contact 1470 can be comprised of any numerous configurations to achieve electrical contact via mechanical means. These means can include, but should not be limited to spring loaded plunger type contacts, male-female insertion type contacts, typical of many RF type connections, and any other means well known by those skilled in the art of implementing these RF connections. Furthermore, the adaptive housing 130 can provide firm mechanical threaded connection to the typical NMO antenna mount (not shown). The NMO mount 1500 provides for a traditional installation for a variety of vehicle mount antenna installations and is well known to those skilled in the art of vehicle antenna implementations. The NMO mount 1500 can be characterized by robust mechanical threading properties, incorporating the male thread for a Unified National Extra Fine (UNEF) standard of 1⅛"-18. The female thread of this same standard type can be incorporated directly within the dielectric support insulator 1420 by several means, including, but not limited to, direct threaded machining, molding threads directly into the internal diameter as part of the molding process, or inserting a threaded component utilizing a press fit, or press fit with combination of ultrasonic weld. An additional method can incorporate the use of a metallic component or insert thread ring 1450, directly molded as an insert component within the dielectric support structure 1420. The insert molding technique affords many benefits including mechanical bonding strength, withstanding torque and environmental sealing, all of which are significant to the performance of a successful insert thread ring implementation. In the exemplary embodiment, a brass material insert thread ring 1450 can be utilized to achieve the required properties and to eliminate unnecessary electro-chemical reactions between dissimilar metals. The material of choice for the mating NMO mount threads can also be fabricated with a brass material for similar purposes mentioned herein. The adaptive housing 130 can include a final molding application of the previously described TPV material, performed as a secondary shot of material that provides the final finishes to the exterior of the adaptive housing surface. The TPV or TPU material is chosen to provide excellent bonding characteristics with the base substrate material described as the ridged dielectric support structure 1420. Furthermore, the semi-rigid dielectric insulator provides an adaptive primary seal against debris and particles deemed intrusive and hindering the performance of the electrically conductive components housed within the adaptive housing 130. A secondary seal for the exemplary embodiment can be accomplished using a standard o-ring 1440. The o-ring 1440, and its associated material properties, is chosen to appropriately seal against all non-desirable natural and unnatural environmental exposures. These exposures can be experienced as natural occurrences of rain and other forced water entry mechanisms, such as automatic car wash and high pressure wash devices. Furthermore, natural occurrences of dirt and debris carried via forced air flow and unwanted chemical intrusion from oil, fuel or other chemicals used in and around vehicle maintenance and operation. The o-ring 1440 is implemented to seal the insert ring 1450 directly against the vehicle mounting surface (not shown).

Figure 15:
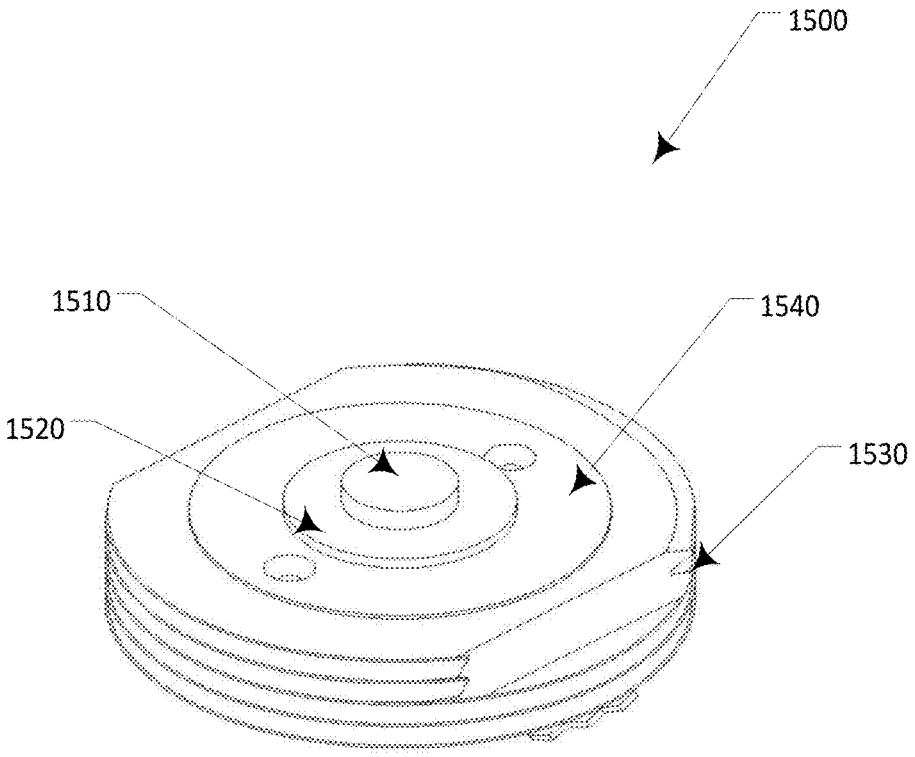
FIG. 15 is an isometric view of a NMO connector launch, used to provide an electrically conductive means between a coaxial transmission line and the primary electrically conductive monopole resonator components.

FIG. 15 illustrates a typical mount that can be used with the antenna 100. The antenna mount or connector launch 1500 is depicted is an isometric view. It is to be appreciated that the antenna mount 1500 can be any suitable antenna mount to physically mount an antenna to a surface. By way of example and not limitation, the antenna mount 1500 can be a traditional antenna mount such as an NMO mount. The antenna mount 1500 can include a coax cable (not shown) that is physically connected to a bottom of the antenna mount 1500. The coax cable can be soldered to attach perpendicularly to a contact point such as contact pin 1510, electrically connecting and establishing the contact pin 1510 as the primary source of RF/Microwave current. The contact pin 1510 may electrically connect to the contact 1470 when the antenna mount 1500 is secured to the adaptive housing 130. The contact pin 1510 is isolated from the secondary electrical conductor components by a dielectric insulator 1520. The secondary electrical conductor is achieved by connection of an antenna mount body 1540 to the mount surface, which is characterized as electrically conductive. A threaded ring 1530 can attach to the antenna mount body 1540. Furthermore, external threads on the threaded ring 1530 can be utilized to attach the antenna mount 1500 to the antenna 100.

Thus, in one embodiment, the contact 1470, contact adapter 1410, insulator support structure 1420, lower resonator 310, feed wire 330, upper resonator 340, top load radiator cap 110, and housing 120 may be used to match the impedance for both low and high frequencies, with the lower frequencies predominantly matched by the top load radiator cap 110 and upper resonator 340 in conjunction with the other components, and the higher frequencies predominantly matched by the lower resonator 310 in conjunction with the other components.

The techniques described herein can be used for various wireless communication systems such as analog, code division multiple access (CDMA), time division multiple access (TDMA), frequency division multiple access (FDMA), orthogonal frequency division multiple access (OFDMA), single carrier-frequency division multiple access (SC-FDMA), long term evolution (LTE) and other systems. The terms "system" and "network" are often used interchangeably.

Furthermore, various embodiments are described herein in connection with a mobile device. A mobile device can include an antenna for communication and can also be called a system, subscriber unit, subscriber station, mobile station, mobile, remote station, remote terminal, access terminal, user terminal, terminal, wireless communication device, user agent, user device, or user equipment (UE). A mobile device can be a cellular telephone, a cordless telephone, a Session Initiation Protocol (SIP) phone, a wireless local loop (WLL) station, a personal digital assistant (PDA), a handheld device having wireless connection capability, a tablet computer, computing device, a communication device with an antenna, or other processing device connected to a wireless modem. Moreover, various embodiments are described herein in connection with a base station. A base station can be utilized for communicating with mobile device(s) and can also be referred to as an access point, Node B, or some other terminology.

What has been described above includes examples of the exemplary embodiment. It is, of course, not possible to describe every conceivable combination of components or methodologies for purposes of describing the claimed subject matter, but one of ordinary skill in the art may recognize that many further combinations and permutations of the subject innovation are possible and fall within the scope of the broader invention.

In regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the disclosed subject matter.

The aforementioned systems have been described with respect to interaction between several components. It can be appreciated that such systems and components can include those components or specified sub-components, some of the specified components or sub-components, and/or additional components, and according to various permutations and combinations of the present disclosure. Subcomponents can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

Figure 16:
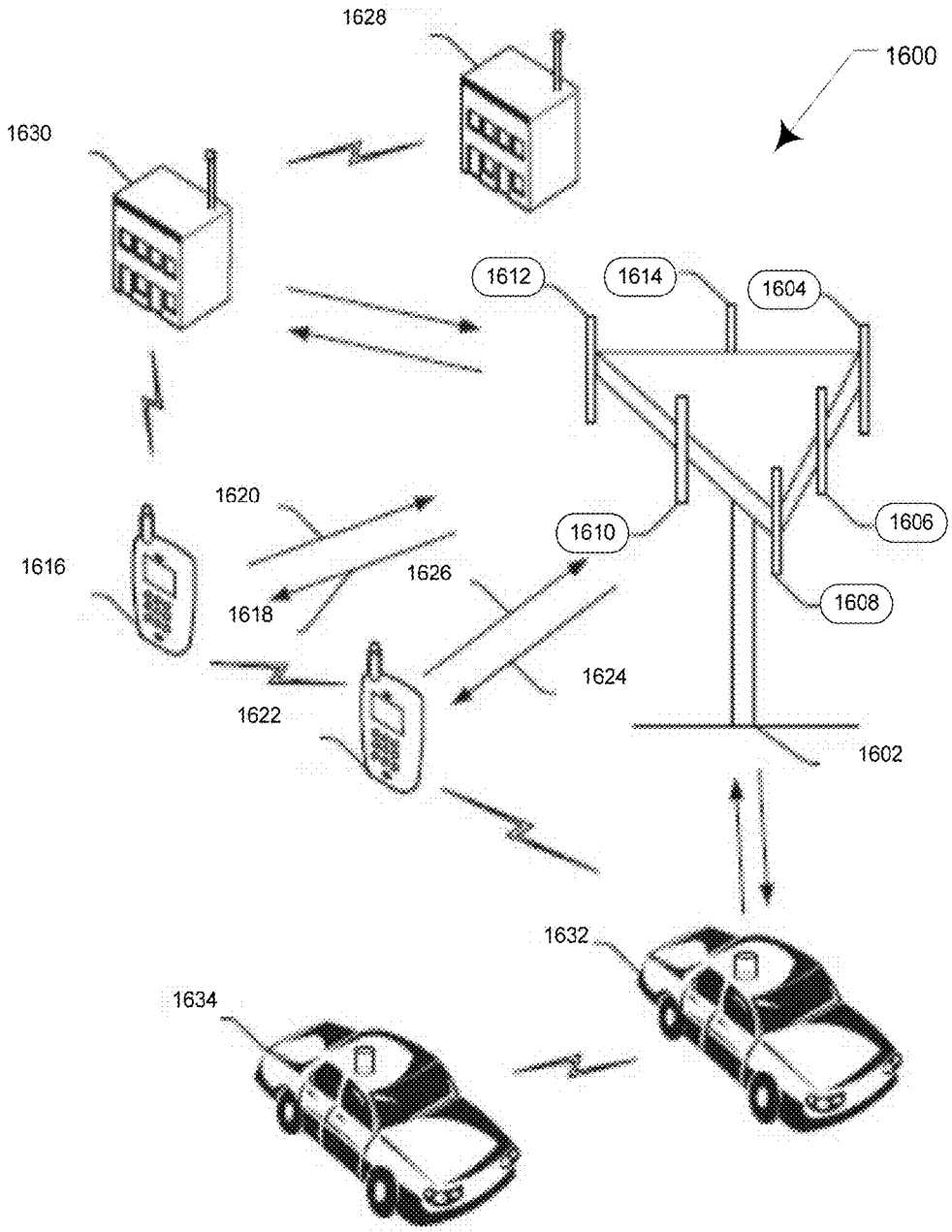
FIG. 16 is a schematic illustration of a wireless communication system.

Referring to FIG. 16, a wireless communication system 1600 is illustrated. The system 1600 can include a base station 1602 that can include multiple antenna groups. For example, a first antenna group can include antennas 1604 and 1606, a second antenna group can comprise antennas 1608 and 1610, and an additional antenna group can include antennas 1612 and 1614. By way of example and not limitation, two antennas are illustrated for each antenna group; however, more or fewer antennas can be utilized for each group. Base station 1602 can additionally include a transmitter chain and a receiver chain, each of which can in turn comprise a plurality of components associated with signal transmission and reception (e.g., processors, modulators, multiplexers, demodulators, de-multiplexers, antennas, etc.), as will be appreciated by one skilled in the art.

By way of example and not limitation, the base station 1602 can communicate with one or more mobile devices such as mobile device 1616 and mobile device 1622; however, it is to be appreciated that the base station 1602 can communicate with substantially any number of mobile devices similar to mobile devices 1616 and 1622. Mobile devices 1616 and 1622 can be, for example, cellular phones, smart phones, laptops, handheld communication devices, handheld computing devices, satellite radios, global positioning systems, PDAs, tablet computers, and/or any other suitable device for communicating over wireless communication system 1600. Moreover, each mobile device can utilize an antenna for communication. As depicted, mobile device 1616 is in communication with antennas 1612 and 1614, where antennas 1612 and 1614 transmit information to mobile device 1616 over a forward link 1618 and receive information from mobile device 1616 over a reverse link 1620. Similarly, mobile device 1622 is in communication with antennas 1604 and 1606, where antennas 1604 and 1606 transmit information to mobile device 1622 over a forward link 1624 and receive information from mobile device 1622 over a reverse link 1626.

Each group of antennas and/or the area in which they are designated to communicate can be referred to as a sector of base station 1602. For example, antenna groups can be designed to communicate to mobile devices in a sector of the areas covered by base station 1602. In communication over forward links 1618 and 1624, the transmitting antennas of base station 1602 can utilize beamforming to improve signal-to-noise ratio of forward links 1618 and 1624 for mobile devices 1616 and 1622. Also, while base station 1602 utilizes beamforming to transmit to mobile devices 1616 and 1622 scattered randomly through an associated coverage, mobile devices in neighboring cells can be subject to less interference as compared to a base station transmitting through a single antenna to all its mobile devices.

Base station 1602 (and/or each sector of base station 1602) can employ one or more multiple access technologies (e.g., AMPS, CDMA, TDMA, FDMA, OFDMA, LTE, . . . ). For instance, base station 1602 can utilize a particular technology for communicating with mobile devices (e.g., mobile devices 1616 and 1622) upon a corresponding bandwidth. Moreover, if more than one technology is employed by base station 1602, each technology can be associated with a respective bandwidth. The technologies described herein can include the following: Specialized Mobile Radio (SMR) Integrated Digital Enhancement Network (iDEN), Advance Mobile Phone System (AMPS), Global System for Mobile (GSM), IS-165 (CDMA), IS-136 (DAMPS), International Mobile Telecommunications-2000 (IMT-2000) (also referred to as 3G), Fourth Generation Cellular Wireless Standards (4G)/Long Term Evolution (LTE), MediaFlo, Digital Video Broadcasting—Handheld (DVB-H), etc. It is to be appreciated that the aforementioned listing of technologies is provided as an example and the claimed subject matter is not so limited; rather, substantially any wireless communication technology is intended to fall within the scope of the hereto appended claims.

As mentioned, each mobile device can include an antenna to transmit and/or receive signals. The wireless communication system 1600 further includes a building 1628 with a fixed antenna for communication, a building 1630 with a fixed antenna for communication, an automobile 1632 with a mobile antenna for communication, and an automobile 1634 with a mobile antenna for communication. As depicted in the wireless communication system 1600, the antenna, fixed or mobile, can communicate with the base station 1602. Furthermore, the fixed antenna associated with the building 1628 can communicate with the fixed antenna associated with the building 1630. Additionally, the mobile antenna related to the automobile 1632 can communicate with the mobile antenna related to the automobile 1634. It is to be appreciated that the fixed antenna associated with the building 1628 and/or the building 1630 can communicate with the mobile antenna associated with the automobile 1632 and/or the automobile 1634. For instance, the automobile 1632 with the mobile antenna can communicate directly with the building 1628 with the fixed antenna (e.g., push-to-talk (PTT), etc.). In general, the antenna can be associated with any mobile device or communication device and can transmit and/or receive signals between each other independent of antenna type or device utilizing such antenna. For example, the antenna communication can be fixed, mobile, fixed to mobile, mobile to fixed, mobile to mobile, fixed to fixed, etc.

Figure 17:
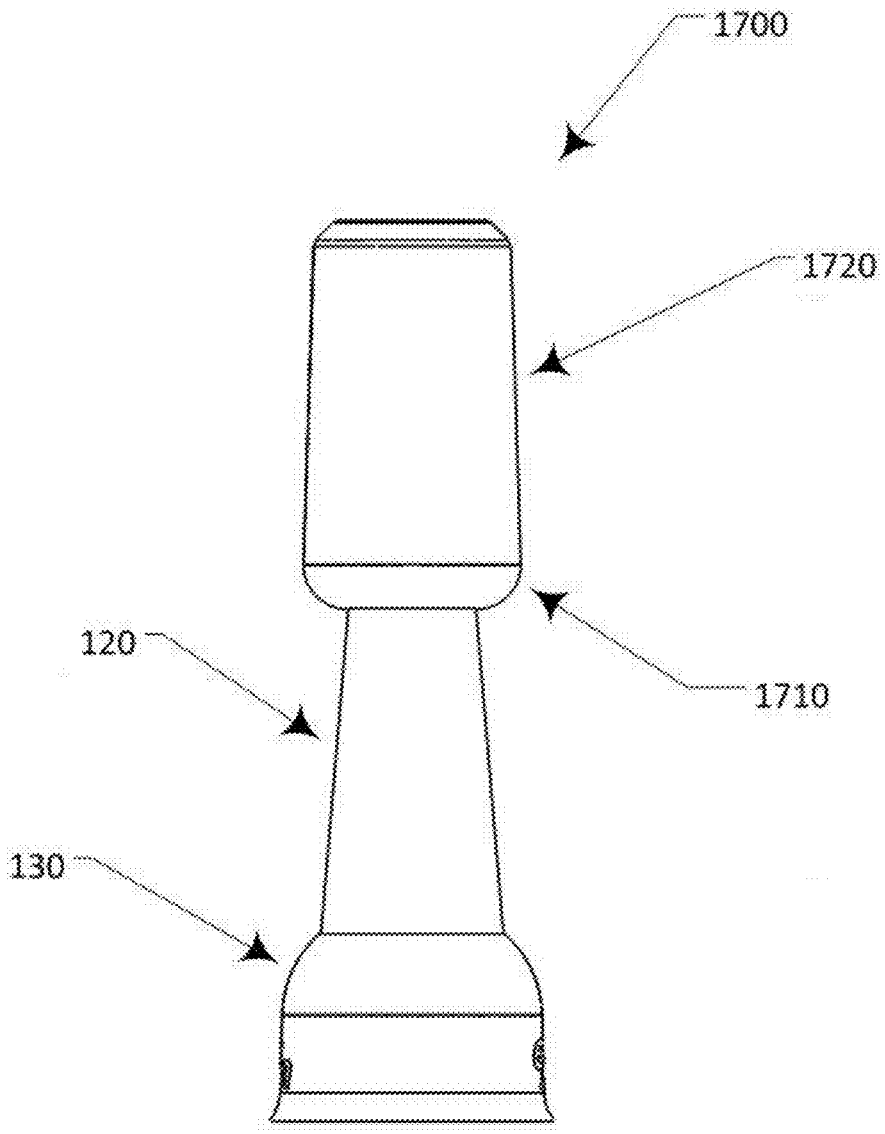
FIG. 17 is a front view of a monopole type antenna that provides for multi-frequency band communication, representing an additional embodiment.

FIG. 17 illustrates a front view of an additional embodiment of an antenna 1700 that facilitates multi-band communication. The antenna 1700 can match impedance with a multiple of frequency signals in order to provide multi-frequency band operation with multiple frequency signals below 1 GHz and multiple high frequency signals above 1 GHz. In particular, the antenna 1700 can incorporate a conductive top load radiator adapter 1710 that enables dual band frequency operation within a low frequency (e.g., 450-520 MHz and 740 MHz to 960 MHz) and a high frequency (e.g., 1 GHz to 3 GHz).

The antenna 1700 can include an adaptive mechanical housing 130 that also provides electrical connectivity from an internal connector launch (referenced at 1500 in FIG. 15) to an upper radiator element (referenced at 340 in various figures) housed within a non-conductive, dielectric support radome housing 120. Furthermore, the housed radiator feed element (or radiator element) is terminated with top load radiator adapter 1710. The top load radiator adapter 1710 is electromagnetically coupled via a radiating/coupling feed wire such that the primary electrically conductive radiator components and the radiator adapter 1710 create a top loaded electromagnetically coupled monopole antenna structure.

Figure 18:
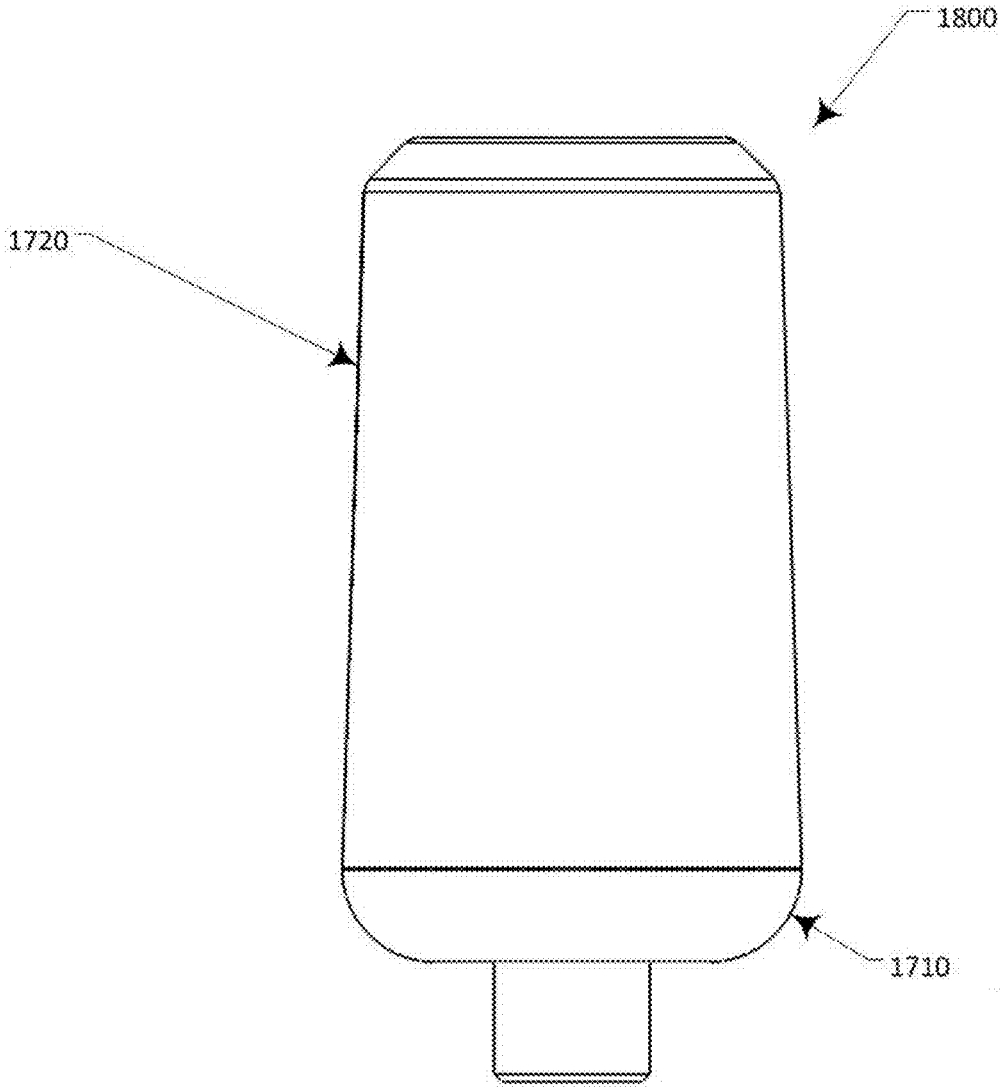
FIG. 18 is a front view of an upper radiating section of a monopole antenna including the radome enclosure, representing an additional embodiment.

FIG. 18 illustrates an upper section 1800 of the additional embodiment monopole antenna 1700. The upper section 1800, or top load radiator assembly 1800, can attach directly to the dielectric support housing 120, in the same manner that top load radiator cap 110 attaches to the top load resonator 340 as shown in FIG. 2. The threaded coupling surface 1850 may couple directly to the top load resonator 340 that is housed within the dielectric support housing 120. The dielectric support housing 120 in FIG. 2 can be mechanically coupled to the top load radiator adapter 1710.

Figure 19:
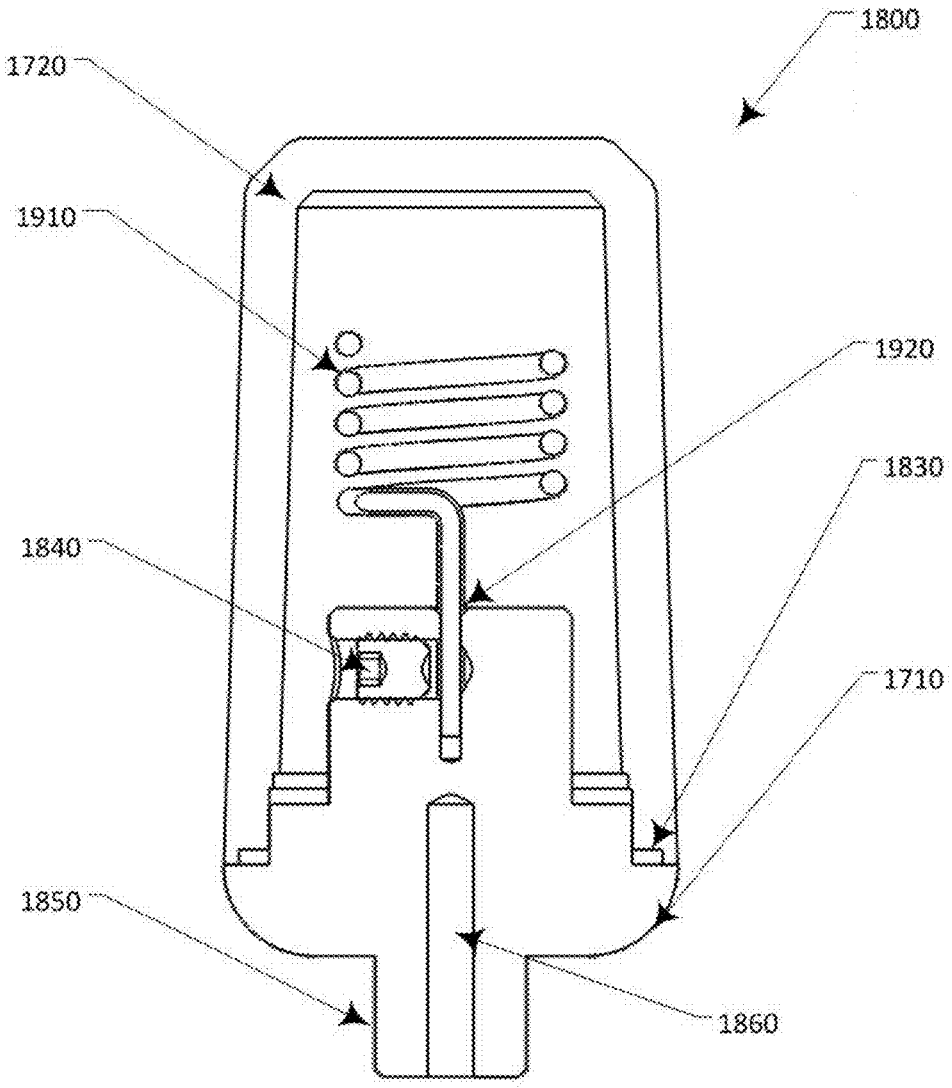
FIG. 19 is a cross-sectional view of the upper radiating section shown in FIG. 18.

FIG. 19 illustrates the cross sectional view of an upper section top load radiator assembly 1800 of an additional embodiment of a monopole antenna 1700. The upper section 1800 includes the top load radiator adapter 1710, top load radiator coil 1910, upper radome housing 1720 (also known as a top load radiator housing 1720), threaded fastener set screw 1840 and a means to provide an environmental seal 1830. Threaded coupling surface 1850 provides both an RF/Microwave electrically conductive connection and mechanical support attachment to top load resonator 340, through interface with top load resonator threaded coupling surface 810. Aperture (or hollow portion) 1860 provides the means for electromagnetic coupling in a similar manner as discussed in the previous exemplary embodiment. This particular additional embodiment may omit the dielectric insulator 350; however, dielectric insulation can be achieved by means of insulated conductive feed wire 330, depicting another variation to the RF/Microwave electromagnetic coupling means, also known by those skilled in the art of designing RF/Microwave coupling structures.

Figure 20:
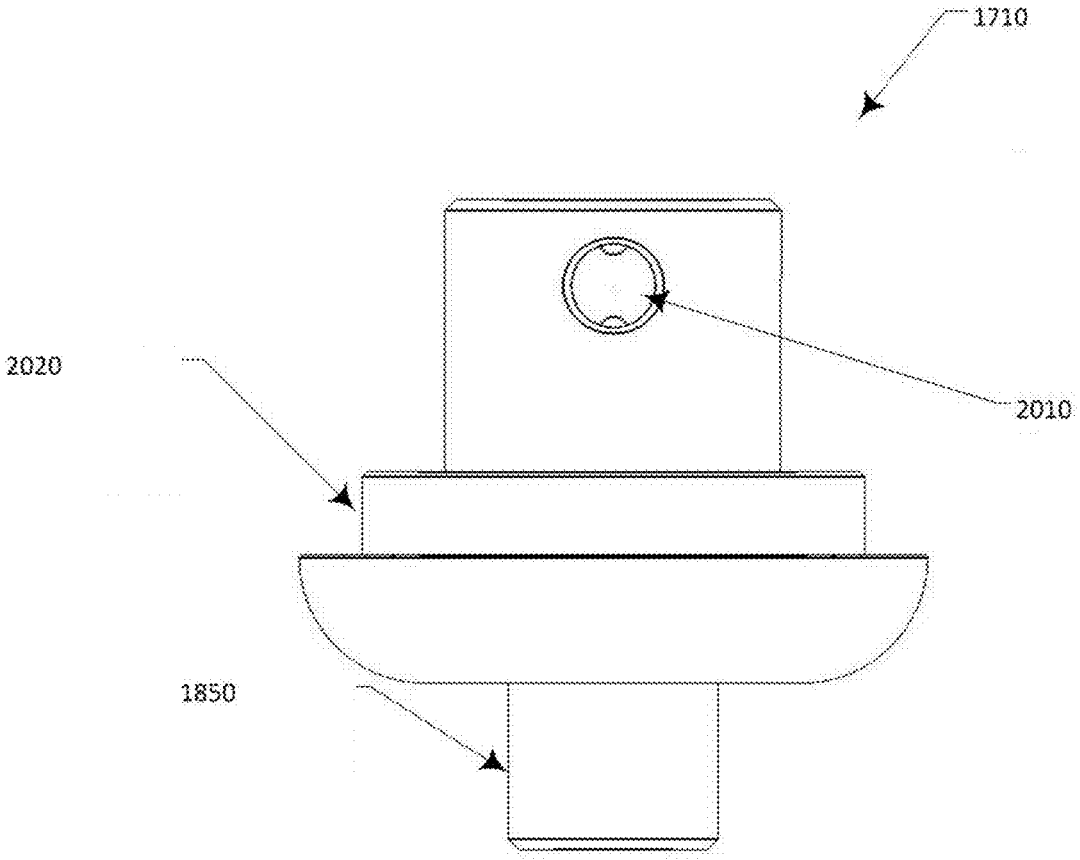
FIG. 20 is a front view of a top load radiator adapter, in support of an additional embodiment of a multi-frequency band monopole antenna.

FIG. 20 illustrates the front view of a top load radiator adapter 1710. The top load radiator adapter provides for electrical top loading in the same manner as top load radiator cap 110 described in the previous exemplary embodiment. The conductive brass or other similar conductive material properties of the top load radiator facilitate the conduction and radiation of RF/Microwave current for frequencies higher than 700 MHz as well as conduction for the lower frequencies in the range of 380-520 MHz. The dimensions chosen for the top load radiator adapter permit an optimal balance of reduced visual profile in conjunction with the required resonance for the 700 MHz and higher frequency bands. Diameter and height dimensions are chosen to optimize the required impedance match and resonance. For this embodiment, the maximum diameter chosen for the top load radiator adapter is 30 mm with an equivalent overall height of 31 mm. Chosen properly, these dimensions satisfy the requirement for providing resonance in the 380-520 MHz and 740-870 MHz range, including higher frequency bands extending up to 2200 MHz. The top load radiator adapter provides for three mechanical attachments. Threaded coupling surface 1850 augments direct attachment to top load resonator 340 as previously discussed. Threaded radome coupling surface 2020 provides a means for mechanical attachment with a radome or environmentally protective housing, namely upper radome housing 1720 for this particular embodiment. Threaded fastener aperture 2010 provides means for a threaded set screw 1840 attachment, that when completely seated, establishes a locking mechanism to secure additional components to the top load radiator adapter through an aperture 1920, located in the top surface and extending down through the center of the top load radiator body. Various dimensions and embodiments of the top load radiator may be easily implemented by those skilled in the art of antenna design to achieve a desired electrical match and radiation characteristics for simultaneous operation in the 380-520 MHz and 700 MHz and higher frequency bands.

Figure 21:
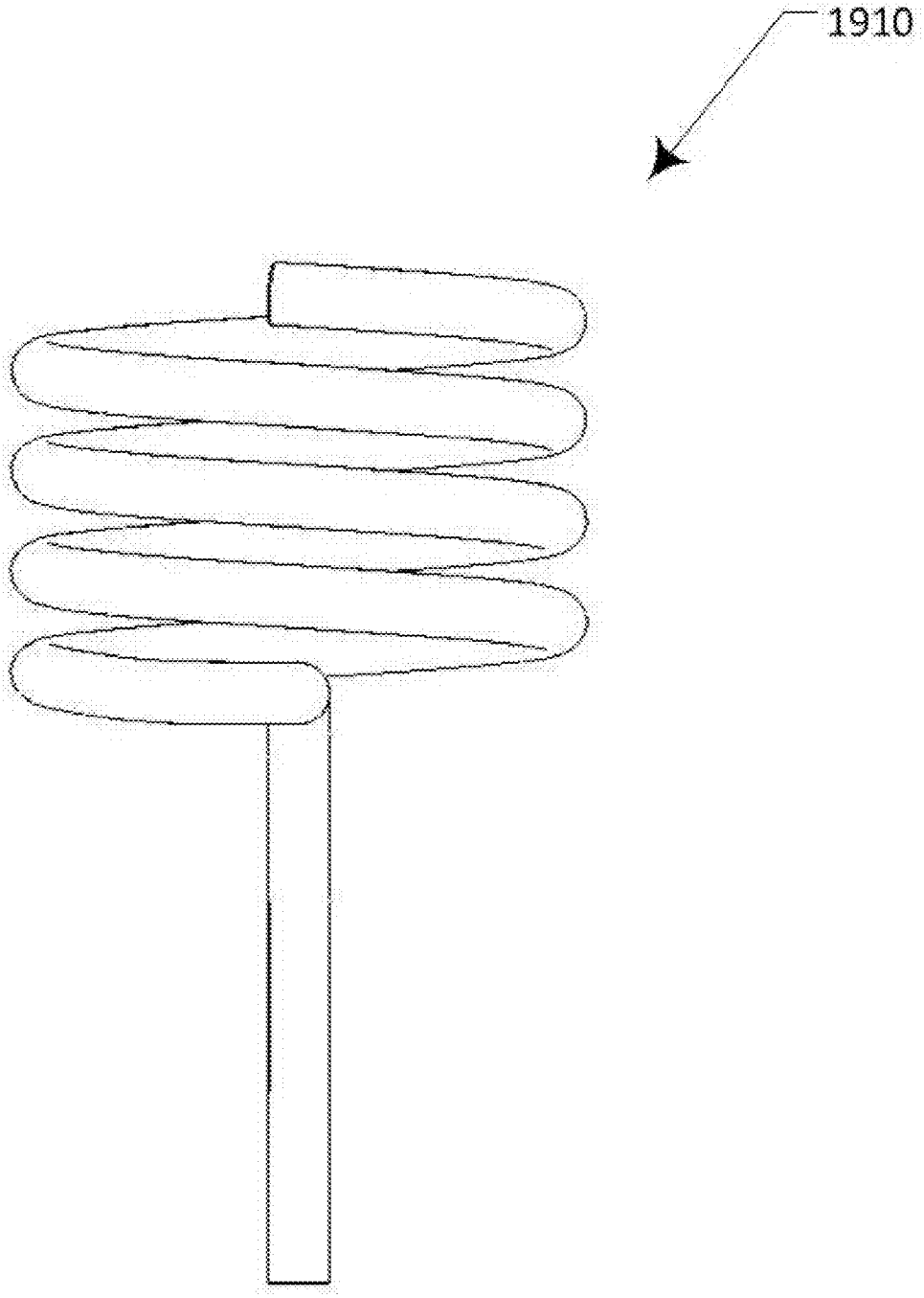
FIG. 21 is a front view of a top load radiator coil, in support of an additional embodiment of a monopole antenna that facilitates low frequency resonance and radiation, and traps high frequency resonance and radiation.

FIG. 21 illustrates a front view of the preferred component of the additional embodiment, namely the top load radiator coil 1910. The top load radiator coil 1910 is constructed of a conductive wire type material that is formed to establish a direct axial attachment through the top surface aperture 1920 of the top load radiator, and secured to the top load radiator adapter 1710 by means of set screw fastener locking mechanism 1840. The wire type material is generally chosen by those skilled in the art to conduct RF/Microwave current and consists of copper, brass, stainless steel and other similarly conductive wire materials. This embodiment employs a wire diameter of approximately 1.6 mm, with an axial pitch of approximately 2.73 mm between each successive turn. The number of complete turns may be 4.0 with an outer diameter of 15.0 mm. The coil dimensions can vary widely for the purpose of tuning specific frequency bands in the 380-520 MHz range. Additional tuning of desired electrical properties can be achieved by altering the number of turns, the diameter of the coil winding and adjustment to the pitch. The coil properties are uniquely chosen to facilitate matched impedance resonance in the desired UHF band of 380-520 MHz while accomplishing the required radiation characteristics, typical of an electrically short top loaded monopole. Additionally, a key component to achieving the multi-frequency band operation is choosing the optimal dimensions of the top load radiator coil such that the higher frequency bands, namely 700 MHz and above, are not permitted to conduct through the coil windings, effectively creating a frequency stop or trap. This technique is well known by those skilled in the art of designing RF/Microwave circuit structures and is sometimes referred to as an RF/Microwave choke. The function of the choke is to conduct or transmit lower band frequencies and stopping higher band frequencies from conducting. The top load radiator coil dimensions chosen for this specific embodiment augment simultaneous operation in the 450-470 MHz, 746-870 MHz and 1700-2200 MHz, and can be adjusted to enhance operation bandwidth to include 450-520 MHz.

Figure 22:
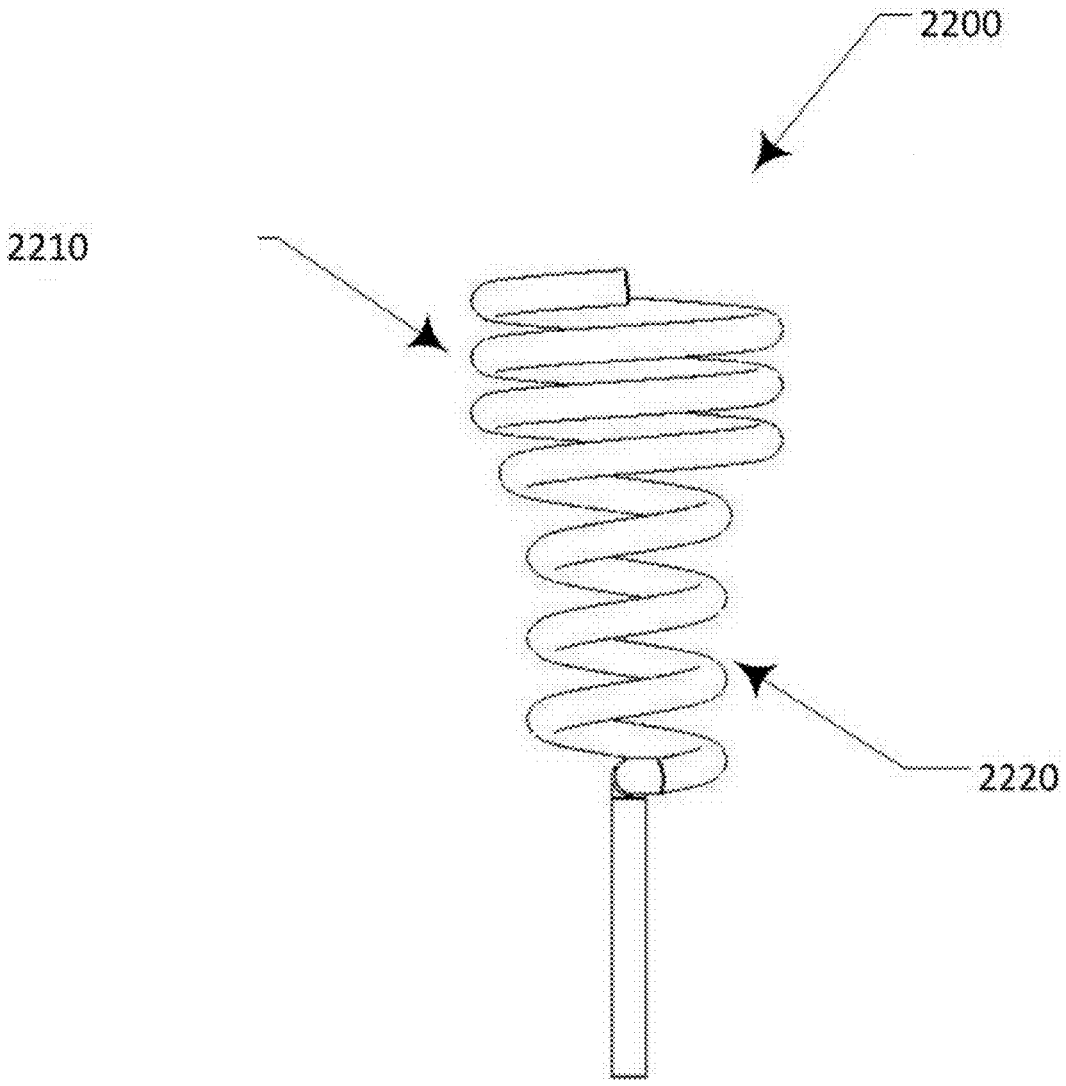
FIG. 22 is a front view of a top load radiator coil with variable pitch and diameter, in support of an additional embodiment of a monopole antenna that facilitates low frequency resonance and radiation with enhanced bandwidth, and traps high frequency resonance and radiation.

FIG. 22 illustrates a front view of an additional embodiment of the top load coil 1910. The top load coil 1910 with singular pitch and diameter can be replaced by incorporating a coil 2200 with variable pitch and diameter. The exemplary pitch and diameter are chosen to achieve broader bandwidth performance for operation in the 450-520 MHz range. The variable top load radiator coil dimensions are chosen carefully to diminish unwanted electrical RF/Microwave discontinuities in the transition region between the top load radiator adapter and the top load radiator coil. The variable coil 2200 utilized to realize the required RF characteristics for the described apparatus includes two sections 2210, 2220 with unique pitch, diameter and number of turns. For the additional exemplary embodiment, the pitch and diameter dimensions chosen include: P1=2.73 mm, D1=15.1 mm; and P2=3.98 mm, D2=9.65 mm. The number of turns for each respective top load coil section include NT1=3 and NT2=4. The variable pitch top load coil embodiment provides a larger degree of freedom for tuning the apparatus and provides one skilled in the art of antenna design various options for optimizing bandwidth and frequency response for the desired result. The design may be realized with any combination of dimensions the designer uses to achieve the desired performance. This shall include any variable pitch any variable diameter and any number of turns the designer deems necessary. The variable top load radiator coil functions in the same manner as discussed previously, but with a reduced Quality factor (Q) which provides for enhanced operational bandwidth for the 450-520 MHz range.

Figure 23:
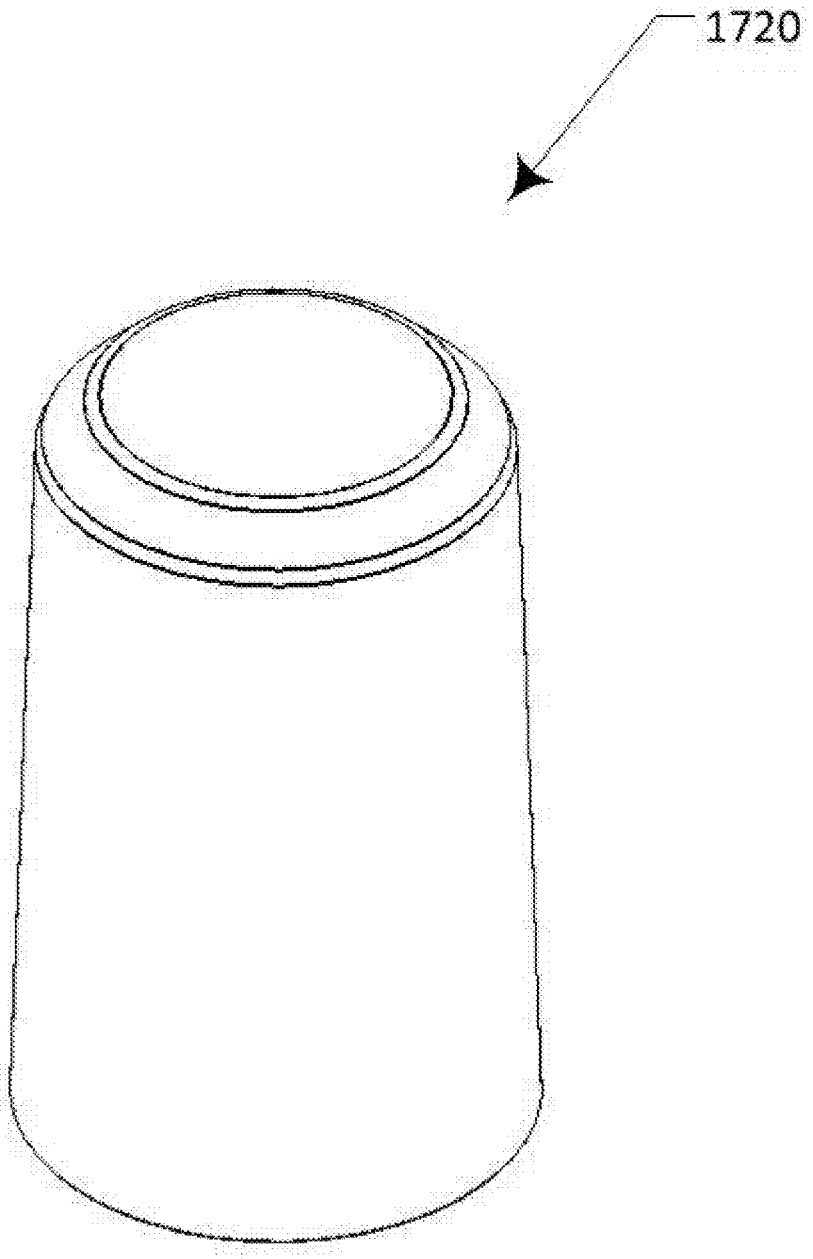
FIG. 23 is a front view of an upper radome housing providing environmental protection for an additional embodiment, which includes top load radiator coil and top load radiator adapter.

FIG. 23 illustrates an isometric view of an upper radome housing 1720 for the additional embodiment discussed. The upper radome housing provides a means for environmental protection for the top load radiator coil 1910, including other components incorporated above the top load radiator adapter 1710 for all embodiments considered by those skilled in the art of antenna design. The dimensions are not critical, but are chosen to reduce the physical profile of the upper radiator assembly while providing a means to encapsulate and isolate the top load radiator components from the free space, outdoor environment. The upper radome housing material properties are also chosen to provide for efficient radiation and low insertion loss between the top load radiator conductive components and the free space environment. Materials such as ABS (Acrylonitrile Butadiene Styrene), ASA (Acrylonitrile Styrene Acrylate), polycarbonate, polyethylene and many other high quality dielectric composites with dielectric constants in the 1.2-4.0 range are well suited for the apparatus and are well known and used by those skilled in the art of antenna and radome design. Additionally, the radome housing is not a requirement for the multi-frequency band operation, as non-radome embodiments can be realized by those skilled in the art of antenna design. This specific additional embodiment discussed incorporates a blended alloy of PC+PBT (Polycarbonate Polybutylene Terephthalate), and provides for efficient signal transmission and reception in the 380-520 MHz, 700-960 MHz and 1700-2500 MHz bands. In one embodiment, this upper radome housing 1720 may be made from a flexible or resilient material such that it provides impact resistance to the housed components.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. An antenna comprising:

a radiator element comprising an upper portion, a lower portion, and an axis running from the upper portion to the lower portion;

a top load radiator cap electromagnetically coupled to the upper portion of the radiator element and matching an impedance of the antenna for at least one low frequency signal, wherein the top load radiator cap is made from a conductive material and further comprises:

a hollow portion; and an insulator tube secured inside the hollow portion;

a first resonator directly connected to the lower portion of the radiator element and matching an impedance of the antenna for at least one high frequency signal;

a second resonator directly secured to the top load radiator cap and made from a conductive material;

a resilient radome housing made from a non-conductive material and enclosing at least a part of a) the radiator element, b) the first resonator, c) the top load radiator cap, and d) the second resonator;

an adaptive housing comprising:

a contact made from a conductive material;

a contact adapter a) made from a conductive material, b) electrically connected to the contact, and c) directly connected to the first resonator; and an insulator support structure made from a non-conductive material, wherein the insulator support structure encloses at least partly the contact and the contact adapter; and an antenna mount comprising:

a contact point made from a conductive material;

a mount body made from a conductive material; and a mount insulator, which insulates the contact point from the mount body;

wherein the antenna mount is directly secured to the adaptive housing such that a) the contact point is electrically connected to the contact, and b) the insulator support structure at least partly encloses the antenna mount;

wherein at least a portion of the radiator element passes through the second resonator;

wherein the upper portion of the radiator element is located inside the insulator tube and is direct-current-isolated from the top load radiator cap;

wherein the top load radiator cap and the second resonator match the impedance of the antenna for the at least one low frequency signal; and wherein the impedance is matched for the at least one high frequency signal and the at least one low frequency signal such that the signals do not interfere with each other.

2. A method comprising the steps of:

a) providing the antenna of claim 1;

b) operating the antenna simultaneously:

1) as a quarter-wave monopole antenna for the at least one low frequency signal; and 2) as a half-wave radiation antenna for the at least one high frequency signal; and c) sending or receiving the at least one high frequency signal and the at least one low frequency signal such that the signals do not interfere with each other.

3. The method of claim 2, wherein the sending or receiving of step c) is done across the top load radiator cap, the second resonator, the radiator element, the first resonator, the contact adapter, and the contact.

4. The method of claim 3, wherein step a) further comprises selecting and designing the following components such that the impedance of the antenna is matched for the at least one low frequency signal and for the at least one high frequency signal: the top load radiator cap, the second resonator, the radiator element, the first resonator, the radome housing, the contact adapter, the contact, and the insulator support structure.

5. The method of claim 4, wherein the at least one high frequency signal operates at a frequency greater than 1 GHz, and wherein the at least one low frequency signal operates at a frequency less than 1 GHz.

6. The method of claim 5, further comprising step:

d) securing the mount body to an associated mount surface;

wherein step d) occurs after step a) and before step b).

7. The method of claim 6, wherein the at least one high frequency signal operates within a range of 1500-3000 MHz, and wherein the at least one low frequency signal operates within a range of 450-960 MHz.

8. An antenna comprising:

a radiator element comprising an upper portion, a lower portion, and an axis running from the upper portion to the lower portion;

a first resonator directly connected to the lower portion of the radiator element and matching an impedance of the antenna for at least one high frequency signal;

a top load radiator assembly comprising:

a top load radiator adapter made from a conductive material and comprising a hollow portion;

a top load radiator coil made from a conductive material and secured directly to the top load radiator adapter; and a top load radiator housing made from a non-conductive material and enclosing at least a part of a) the top load radiator adapter, and b) the top load radiator coil;

a second resonator directly secured to the top load radiator adapter and made from a conductive material;

a resilient radome housing made from a non-conductive material and enclosing at least a part of a) the radiator element, b) the first resonator, c) the top load radiator adapter, and d) the second resonator;

an adaptive housing comprising:

a contact made from a conductive material;

a contact adapter a) made from a conductive material, b) electrically connected to the contact, and c) directly connected to the first resonator; and an insulator support structure made from a non-conductive material, wherein the insulator support structure encloses at least partly the contact and the contact adapter; and an antenna mount comprising:

a contact point made from a conductive material;

a mount body made from a conductive material; and a mount insulator, which insulates the contact point from the mount body;

wherein the antenna mount is directly secured to the adaptive housing such that a) the contact point is electrically connected to the contact, and b) the insulator support structure at least partly encloses the antenna mount;

wherein a) the upper portion of the radiator element is located inside the hollow portion of the top load radiator adapter and is direct-current-isolated from the top load radiator adapter, and b) at least a portion of the radiator element passes through the second resonator;

wherein the top load radiator assembly and the second resonator match the impedance of the antenna for the at least one low frequency signal;

wherein the impedance is matched for the at least one high frequency signal and the at least one low frequency signal such that the signals do not interfere with each other; and wherein the top load radiator assembly is electromagnetically coupled to the upper portion of the radiator element and matches an impedance of the antenna for at least one low frequency signal.

9. The antenna of claim 8, wherein a pitch and a diameter of the top load radiator coil are both singular.

10. The antenna of claim 8, wherein a pitch and a diameter of the top load radiator coil are both variable.

11. The antenna of claim 8, wherein the top load radiator coil is designed to trap frequencies above 700 MHz, wherein the impedance of the antenna is matched for at least two low frequency signals, at least one of which is below 700 MHz and at least one of which is above 700 MHz.

12. The antenna of claim 11, wherein the radiator element further comprises an insulated wire.

13. A method comprising the steps of:

a) providing the antenna of claim 11;

b) operating the antenna simultaneously:

1) as a quarter-wave monopole antenna for the at least two low frequency signals; and 2) as a half-wave radiation antenna for the at least one high frequency signal; and c) sending or receiving the at least one high frequency signal and the at least two low frequency signals such that the signals do not interfere with each other.

14. The method of claim 13, wherein the at least one high frequency signal operates within a range of 1500-3000 MHz, wherein at least one low frequency signal operates within a range of 380-520 MHz, and wherein at least one low frequency signal operates within a range of 740-960 MHz.

* * * * *